US005859508A

United States Patent [19]

Ge et al.

[11] Patent Number: 5,859,508

[45] Date of Patent: *Jan. 12, 1999

[54] ELECTRONIC FLUORESCENT DISPLAY SYSTEM WITH SIMPLIFIED MULTIPLE ELECTRODE STRUCTURE AND ITS PROCESSING

[75] Inventors: Shichao Ge; Xi Huang, both of San Jose; Yi Xu, Cupertino; Charles S. Leung, San Jose, all of Calif.

[73] Assignee: Pixtech, Inc., Santa Clara, Calif.

[ * ] Notice: The term of this patent shall not extend beyond the expiration date of Pat. No. 5,565,742.

[21] Appl. No.: 846,029

[22] Filed: Apr. 25, 1997

Related U.S. Application Data

[63] Continuation of Ser. No. 306,486, Sep. 15, 1994, abandoned, which is a continuation-in-part of Ser. No. 70,343, Jul. 2, 1993, Pat. No. 5,565,742, which is a continuation-in-part of Ser. No. 730,110, Jul. 15, 1991, Pat. No. 5,229,691, which is a continuation-in-part of Ser. No. 657,867, Feb. 25, 1991, Pat. No. 5,170,100.

[51] Int. Cl.[6] ..... G09G 1/04; H01J 29/70

[52] U.S. Cl. ..... 315/366; 313/422

[58] Field of Search ..... 315/866; 313/422, 313/292, 243, 267–8, 257

[56] References Cited

U.S. PATENT DOCUMENTS

| | | | |
|---|---|---|---|
| 3,935,500 | 1/1976 | Oes et al. . | |
| 4,112,329 | 9/1978 | Veith | 313/491 |
| 4,183,125 | 1/1980 | Meyer et al. | 29/25.15 |
| 4,340,838 | 7/1982 | Kobale et al. | 313/348 |
| 4,651,049 | 3/1987 | Saeki et al. | 315/355 |
| 4,955,681 | 9/1990 | Sekihar et al. | 313/495 |
| 4,973,888 | 11/1990 | Morimoto et al. | 315/366 |
| 5,126,628 | 6/1992 | Kishimoto et al. | 313/482 |
| 5,170,100 | 12/1992 | Shichao et al. | 315/366 |
| 5,205,770 | 4/1993 | Lowrey et al. | 445/24 |
| 5,229,691 | 7/1993 | Shichao et al. | 315/366 |
| 5,413,513 | 5/1995 | Horne et al. | 445/24 |
| 5,424,605 | 6/1995 | Lovoi | 313/422 |
| 5,436,530 | 7/1995 | Susuki et al. | 315/169.1 |
| 5,565,742 | 10/1996 | Shichao et al. | 315/366 |

FOREIGN PATENT DOCUMENTS 62150638 12/1988 Japan .

*Primary Examiner*—Gregory C. Issing
*Attorney, Agent, or Firm*—Majestic, Parsons, Siebert & Hsue, PC

[57] ABSTRACT

An improved cathodoluminescent device with a one piece spacer structure which is rigidly connected to two sets of grid electrodes. The spacer structure defines holes therein that spatially match pixel dots on an anode on a face plate. One set of grid electrodes comprises layers of electrically conductive material on surfaces within at least some of the holes of the spacer structure. The two sets of grid electrodes and different spacer layers may be attached together to form a one piece spacer structure integral with the two sets of grid electrodes. The display device is then simply assembled by matching each of the holes of the spacer structure with a pixel dot on the face plate, and attaching the structure to the face plate and a back plate.

15 Claims, 9 Drawing Sheets

ELECTRONIC FLUORESCENT DISPLAY SYSTEM WITH SIMPLIFIED MULTIPLE ELECTRODE STRUCTURE AND ITS PROCESSING

CROSS-REFERENCE TO RELATED APPLICATION

This is a continuation of application Ser. No. 08/306,486, filed Sep. 15, 1994, now abandoned, which is a continuation-in-part of application Ser. No. 08/070,343, filed Jul. 2, 1993, which issued as U.S. Pat. No. 5,565,742, which is a continuation-in-part of application Ser. No. 07/730,110, filed Jul. 15, 1991, which issued as U.S. Pat. No. 5,229,691, which is a continuation-in-part of application Ser. No. 07/657,867, filed Feb. 25, 1991, issued as U.S. Pat. No. 5,170,100.

BACKGROUND OF THE INVENTION

This invention relates in general to flat panel electronic fluorescent display devices and, in particular, to an improved flat matrix cathodoluminescent device with simplified multiple electrode structure and innovative processing methodologies particularly useful for large-area single piece full color hang-on-wall type displays.

Researchers in many flat panel display technologies, such as LCD, PDP, EL, LED, VFD, flat CRT, have been trying to develop a full-color hang-on-wall television. Color televisions of several-inch to slightly over 10-inch screens using LCD technology have been produced. Such televisions using LCD employ a large number of thin film transistors on their basic boards and are expensive. Because of difficulties and complexities in manufacturing these LCD displays, increasing the screen size of the LCD display is a formidable task and is very expensive. LCD displays employ a back illuminator scheme with color filters and polarizers. The base board using thin film transistors to control the front end light shutter transmits a low proportion of light from the backlight source and thus limits the brightness of the display. Because of these difficulties, research in the large-area (above 25-inch diagonal) display based on LCD technology has been primarily focused on projection display.

Full-color displays using Plasma Display Panel (PDP) technology have been limited to 40-inch screen size due to the complexity in fabrication of the discharge cells. In large-area full-color PDP displays, the main problems include the low efficiency in phosphorescence, low brightness, complicated IC driving circuitry, and the short product lifetime. Research in LED and EL displays have been in the development of a cost efficient luminescent material for emitting blue light. While multi-color displays have been developed using VFD technology, such devices are limited to smaller display screen sizes. Furthermore, except from the use of luminescent materials such as zinc oxide for generating blue-green light, the brightness, luminance efficiencies and product lifetimes of other color phosphors are not acceptable in the low operating voltage range of the VFD. From the above-mentioned shortcomings of these display technologies, it will be evident that large-area flat full color hang-on-wall displays that have been proposed using these existing flat panel display technologies are not entirely satisfactory.

Cathode ray tubes (CRT) have been widely used for display purposes such as consumer television systems because of its affordable costs. These tubes operate by scanning electron beams from a single electron gun. This conventional configuration inevitably adds depth to the dimensions of the device and limits it to small screen size. Thus, these CRT systems are bulky and are difficult to manufacture where the display screen size is larger than 40 inches. In many applications, it is preferable to use flat display systems in which the bulk of the display is much reduced. In U.S. Pat. No. 3,935,500 assigned to Oess et al., for example, a flat matrix CRT system has been proposed where a monolithic stack in which electron beams are formed and through which the beams are selectively projected onto a phosphor coated face plate. The stack structure has a number of holes through which electron beams may pass and sets of X-Y deflection electrodes are used to simultaneously control all the beams. The deflection control structure define by Oess et al. is commonly known as a mesh-type CRT structure. While the mesh-type flat CRT structure is simple in form, these structures are expensive to make, particularly in the case of large-area display systems.

Other conventional flat panel systems currently used include Jumbotron and Flatvision such as that described in Japanese Patent Publication Nos. 62-150638 and 62-52846, as well as in U.S. Pat. No. 4,955,581, respectively. The structures used in the Jumbotron and Flatvision display devices are somewhat similar to the flat matrix CRT described above. Each anode in the Jumbotron includes less thatn 20 pixels so that it is difficult to construct a high resolution display device with high phosphor dot density type display system using the Jumbotron structure.

The Flatvision having a shallow depth (~4.0 inches) consists of multiple sources of electron beams that are focused and aimed by a series of multiple electrodes arranged in sheetlike layers. Electrical charges are used to electrostatically deflect or aim the beams to hit the proper phosphor dots. Such flat CRT device requires precise alignment of the multiple grid electrodes to provide good image quality. Complex driving circuitry is required to control the passage of electron beams for scanning and data modulation.

The flat matrix CRT, Jumbotron and Flavision structures are somewhat similar in principle to the flat CRT system described by Oess et al. discussed above. These structures amount to no more than enclosing a number of individually controlled miniature electron guns within a panel, each gun equipped with its own grid electrodes for controlling the X-Y addressing and/or brightness of the display. In the above-described CRT devices, the control grid electrodes used are either in the form of mesh or perforated sheet structures. These mesh/sheet structures are typically constructed using photo-etching by etching holes in a conductive plate. The electron beams originating from the cathodes of the electron guns then pass through these holes in the mesh/sheet structures to reach a phosphor material on the anodes. As noted above, large-area mesh/sheet structures are difficult to handle in the manufacturing process of these display devices. Since the electron beam must pass through holes in the mesh/sheet structure, a large number of electrons originating from the cathode will not travel through the holes, but are lost to the solid part of the structure to become grid current such that only a small portion of the electrons will be able to escape through the holes and reach the phosphor material on the anode plate. For this reason, the osmotic coefficient, which is defined as the ratio of the area of the hole to the area of the mesh structure of the control electrode grid, of the above-described device is quite low.

As taught in U.S. Pat. No. 5,170,100 by Ge Shichao et al., to avoid the problem of low osmotic coefficient in conventional display devices, instead of using individually controlled electron guns, an electrofluorescent device (EFD) is proposed where two or more sets of elongated grid electrodes may be employed for scanning and controlling the brightness of pixels at the entire anode where the area of the grid electrodes that blocks electrons is much smaller than the area of the mesh structure of the conventional devices.

The above-described CRT-based devices have another drawback. In the case of the Jumbotron, each electron gun is used for scanning a total of 20 pixels. In the Oess et al. patent referenced above, each electron beam passing through a hole is also used for addressing and illuminating a large number of pixels. In the flat panel version, complex circuitry is required to drive a large number of electron beams for a 14-inch display device. When illumination at a particular pixel is desired, certain voltages are applied to the X-Y deflection electrodes on the inside surface of the hole, causing electrons in the electron beam passing through the hole to impinge the anode at such pixel. However, electrical noise and other environmental factors may cause the electron beam in the Oess et al. system, the Jumbotron and the Flatvision to deviate from its intended path. Furthermore, certain electrons will inevitably stray from the electron beam path and land in areas of the anode which are different from the pixel that is addressed. This causes pixels adjacent to the pixel that is addressed to become luminescent, causing crosstalk and degrades the performance of the display.

As is known to those skilled in the art, the inner chamber of a cathodoluminescent visual display device must be evacuated to high vacuum so that the electrons emitted by the cathode would not be hindered by air molecules and are free to reach the phosphor elements on the anode. For this reason, the housing that contains the cathode, anode and control electrodes must be strong enough to withstand atmospheric pressure when the chamber within the housing is evacuated to high vacuum. When the display device has a large surface area, as in large-screen displays, the force exerted by the atmosphere on the housing can be substantial especially when the chamber is evacuated to very high varuum ($<10^{-7}$ Torr). For this reason, conventional flat cathodoluminescent display devices have employed thick face and back plates to make a sturdy housing. Such thick plates cause the housing to be bulky so that the device is heavy, expensive and difficult for manufacture.

It is important in flat panel displays of the electronic fluorescent type that the spacer wall charging effect should be eliminated. There is a high voltage differential between the cathode and the display surface. The electrical breakdown between the electron emitting surface and the display surface must be prevented. Although numerous approaches have been used, the results were not very satisfactory especially for flat displays type where the spacing between the front light emitting surface and the back cathode has to be kept small. Eventhough the wall charging effect can be controlled using multiple electrodes to direct the passage of electrons, fabrication of multiple electrodes for such purpose requires precise control of spacing between each layer of the multiple electrodes and alignment of each electrode components for the electron to pass through. It is therefore desirable to provide an improved flat cathodoluminescent visual display device where the above-described difficulties are not present.

SUMMARY OF THE INVENTION

This invention is based on the observation that by employing a simplified multiple electrode structure in the cathodoluminescent visual display device, matrix addressing can be accomplished through two sets of control grid electrodes, and preferably only one spacer structure is required with one set of control electrodes deposited on the spacer structure.

The use of support pillars in the back plate in the preferred embodiment allows not only rigid support of the flat display device but also a light weight device to be constructed. Most importantly, the simplified multiple electrode structure provides the realization of manufacturing a cost-effective large-area flat panel display having image quality comparable to the bright and crisp color of conventional CRTs.

One aspect of the invention is directed towards a cathodoluminescent visual display device having a plurality of pixel dots for displaying images when the device is viewed in a viewing direction. The device comprises a housing defining a chamber therein, the housing having a face plate and a back plate. The device also includes an anode on or near the face plate, luminescent means that emits light in response to electrons, and that is on or adjacent to the anode; at least one cathode in the chamber between the face and back plates; and at least a first and a second set of elongated grid electrodes between the anode and cathode, the electrodes in each set overlapping the luminescent means and grid electrodes in at least one other set at points when viewed in the viewing direction, wherein the overlapping points define pixel dots; means for causing the cathode to emit electrons to form an electron cloud; and means for applying electrical potentials to the anode, cathode and the two sets of control grid electrodes causing the electrons emitted by the cathode to travel to the luminescent means at the pixel dots on or adjacent to the anode for displaying images. The device further includes an integral spacer structure (i.e. a one piece core multiple electrode structure) rigidly connected to the two sets of control grid electrodes.

In the preferred embodiment, the device also includes support pillars between the face plate and the spacer structure to provide rigid mechanical support for the device so that the housing would not collapse when the housing is evacuated. In the preferred embodiment of the invention, spacer structure defines holes that each permits electron passage to address a plurality of pixel dots, and one set of grid electrodes is deposited onto the surfaces of the holes to enable electron focusing through the holes. The spacer structure may include individual layers rigidly held together by high temperature adhesives. In the preferred embodiment, the spacer structure includes supporting means and control means for the passage of electron to be directed towards the luminescent means. The control means may further includes thin partition or separation walls to eliminate crosstalk and the supporting means is made of material having the proper resistivity range to reduce charging.

Another aspect of the invention is directed to a method for making a cathodoluminescent visual display device having a plurality of pixel dots for displaying images when said device is viewed in a viewing direction. The method comprises the following steps:

(a) fabricating a spacer plate, said spacer plate defining holes therein for passage of electrons between an anode and one or more cathodes, wherein a predetermined number of one or more pixel dots correspond to and spatially overlap one hole, said fabricating step including depositing an electrically conducting film on said spacer plate to serve as a set of grid electrodes;

(b) aligning and attaching a mesh structure and separation spacers onto the spacer plate to serve as an additional set of grid electrodes so that the separation spacers separate the two sets of grid electrodes, and so that the electrodes in each set of grid electrodes overlap the grid electrodes in the other set at intersection points that overlap said pixel dots when viewed in the viewing direction, the spacer plate, the mesh structure and the separation spacers forming an integral rigid spacer structure;

(c) aligning and attaching a face plate having luminescent means thereon defining pixel dots to the spacer structure so that the pixel dots are aligned with the intersection points; and (d) attaching a back plate to the spacer structure and connecting cathode filaments to the back plate.

Yet another aspect of the invention is directed to a cathodoluminescent visual display device having a plurality of pixel dots for displaying images when said device is viewed in a viewing direction, comprising a housing defining a chamber therein, said housing having a face plate, and a back plate; an anode on or near said face plate in an anode plane; luminescent means that emits light in response to electrons, and that is on or adjacent to the anode; a plurality of cathodes in the chamber between the face and back plates in a cathode plane and at least a first and a second set of elongated grid electrodes between the anode and cathode planes in a first and second grid plane respectively, said first grid plane being closer to the cathode plane than the second grid plane, the electrodes in each set overlapping the luminescent means and grid electrodes in at least one other set at points when viewed in the viewing direction, wherein the overlapping points define pixel dots. The device further comprises means for causing the cathode to emit electrons into an electron cloud; means for applying electrical potentials to the anode, cathode and the two or more sets of grid electrodes, causing the electrons emitted by the cathode to travel to the luminescent means at the pixel dots on or adjacent to the anode for displaying images; and spacer means connecting the face and back plates to provide mechanical support for the plates so that the housing will not collapse when the chamber is evacuated, said spacer means including a spacer plate defining holes therein for passage of electrons between the anode and cathode, the cathodes being located and the electrical potentials applied to the anode, cathodes and grid electrodes being such that electrons from the electron cloud are channeled through holes distributed over an area of said spacer plate defining an effective area of the spacer plate. The distance between the at least one cathode to the first grid plane is more than 5% of the distance between the at least one cathode and the anode plane, and the electrons from the electron cloud emitted by the at least one cathode passing to the anode are impeded only by the grid electrodes and the spacer plate, said spacer plate blocking passage of said passing electrons over less than 80% of the effective area of the spacer plate. Moreover, the cathode plane is less than 40 mm. from the anode plane.

For large-area displays, it is desirable for the cathode to be broken up into short segments to reduce the amount of sagging and for easy assembling. One common problem in cathodoluminescent visual display systems is that the two ends of the filament in a cathode are colder than the intermediate portion and for that reason, emits few electrons compared to the intermediate portion. When a long cathode is broken up into shorter filament segments, the above problem of non-uniform electron emission at the ends of the filaments is compounded. This problem is alleviated by arranging the ends of the filaments in such a way that the end portion of each filament segment is proximate to and overlaps an end portion of a different filament segment when viewed in the viewing direction since the groups of filaments are arranged in parallel to each other to form the cathode plate for efficient generation electrons. Non-uniform emission electron is seen as viewed in the viewing direction because of the pitch of filament arrangements. This problem can also be alleviated by the use of electron shaping means to distribute the emissions of electrons more evenly from the filaments towards the viewing direction. This invention is based on the observation that by arranging sets of electrodes on the anode plate behind the filaments, to generate an electrical field profile directly behind the filament to direct the electrons to travel in more uniform forward directions so as to improve brightness uniformity. Hence there is a direct relationship between the spacing of the set of electron shaping electrodes on the anode or back plate and the pitch of the filament arrangement that are in parallel to the electron shaping electrodes.

Another aspect of the invention is directed to the method of assembling the spacer structure and the display device using the structure in the present embodiment. Spacer structures commonly used in display devices are made of insulating materials to prevent shorting of the high voltage applied to control the passage of electrons. One of the major problems in the production of large-area, high resolution flat panel display devices is the charging effect when the anode and cathode and control grid electrodes are brought closer together. One approach is to coat high resistive material onto the insulating material to reduce charging. Graphite coatings have been used in conventional cathodoluminescent visual displays, but because of the close proximity of the anode, cathode and control grid electrodes, graphite coating is not desirable because of its residual electrical field that can affect image quality during device operation. Furthermore, coating is an additional processing step in the manufacturing process of the display device that adds cost to the product. The method comprises forming the spacer structure with two layers, the metal-form layer consisting of array of openings separated by thin partition wall to define a chamber that contains the phosphor dots; and the insulating support layer to define the spacing between control grid electrode and the high voltage anode plate. The metal-form layer is coated with insulating material with a deposited conducting layer on the inside wall of the thin partition to form the control grid electrode partition. The two layers are then joined together with high temperature adhesive to form the spacer structure. Major advantages in using this type of spacer structure include the versatility in choosing materials with the proper volume resistivity to eliminate charging, the rigidity of the metal form to enhance mechanical strength when compared to glass/ceramic material as well as precise pattern definition on metal form.

BRIEF DESCRIPTION OF THE DRAWINGS

For simplicity in description, identical components in steps are identified by the same numerals in the different figures of this application.

DETAILED DESCRIPTION OF THE PREFERRED EMBODIMENT

Set forth below is description largely incorporated from parent application Ser. No. 08/070,343 in reference to FIGS. 1A–4, which are the same as the FIGS. 1A–4 of Ser. No. 08/070,343.

Figure 1B:
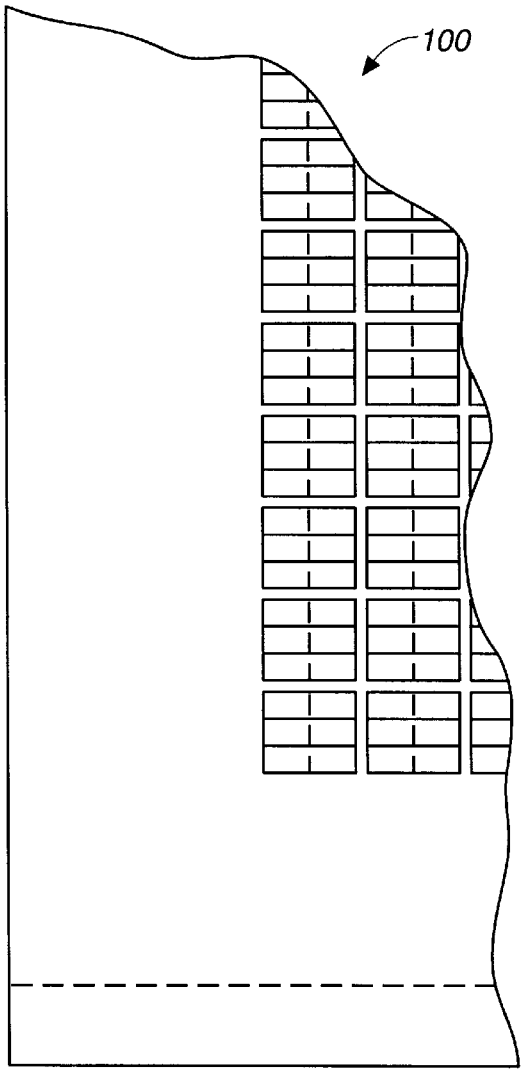
FIG. 1B is a front view of the device of FIG. 1A but where the current source of FIG. 1A is not shown.
Figure 1A:
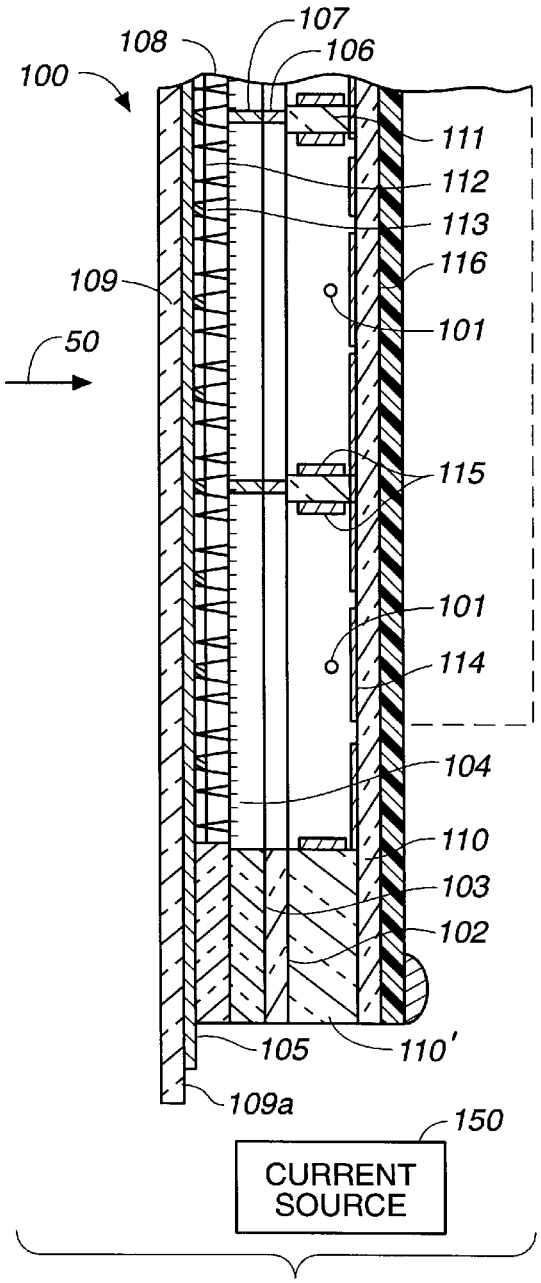
FIG. 1A is a cross-sectional view of a portion of a cathodoluminescent visual display device to illustrate the preferred embodiment of the invention.

FIG. 1A is a cross-sectional view of a portion of a flat panel cathodoluminescent visual display device 100 and of a current source 150 for supplying power to device 100 to illustrate the preferred embodiment of the invention. FIG. 1B is a front view of device 100 of FIG. 1A along a viewing direction 50 of FIG. 1A. Since the appearance of the device and of all devices described herein is the determinating factor in many instances, the "viewing direction" hereinafter will refer to a direction viewing the display device from the front of the device as in FIGS. 1A and 1B as is normally the case when a viewer is observing a display, eventhough such direction is not shown in many other figures. In this context, if two components of the device overlap or non-overlap when viewed in such viewing direction, such components are referred to below as "overlapping" or "non-overlapping." Device 100 includes cathodes 101, three sets of grid electrodes 102, 103, 104 anode 105 and spacers 106, 107 and 108. These electrodes and parts are sealed in a chamber enclosed by face plate 109 and back plate 110 and side plate or wall 110' where the face, back and side plates are attached to form a portion of a housing for a flat vacuum device, surrounding and enclosing a chamber. The chamber of device 100 enclosed by the face, side and back plates is evacuated so that the electrons generated at the cathodes travel freely towards the anode in a manner described below.

Cathodes 101 form a group of substantially parallel direct heated oxide coated filaments. Each of the three sets of grid electrodes 102, 103 and 104 comprises substantially parallel thin metal wires. In the preferred embodiment in FIG. 1A, between the first set of grid electrodes 102 referred to below as G1 and back plate 110 is a group of substantially parallel elongated spacer members 111 placed alongside filaments 101 and are preferably parallel to the filaments 101. Metal wires G1 are attached to spacers 111 to reduce the amplitude of their vibrations caused by any movements of the device. Between the first set of grid electrodes 102 (G1) and the second set of electrodes 103 (G2) is a spacer structure 106 which is net-shaped, the structure defining meshes therein, each permitting electron passage between the cathode and the anode to address a plurality of pixel dots. Between the second set of grid electrodes 103 (G2) and a third set of grid electrodes 104 (G3) is another spacer structure 107 preferably similar in structure to structure 106. These two spacer structures separate the three sets of grid electrodes. The wires of the three sets of grid electrodes may be attached to these two spacer structures as well to reduce vibrations.

On the inside surface 109*a* of face plate 109 is anode 105 comprising a layer of transparent conductive film having three primary color low voltage cathodoluminescent phosphor dots 112, and black insulation layer 113 between the phosphor dots io enhance contrast. Between anode 105 and the third set of electrodes 104 (G3) is a spacer plate 108 having holes therein, where the holes overlap and match the phosphor dots and anode. This means that each hole in spacer plate 108 corresponds to a small number of a predetermined group of pixel dots forming a pixel, and has substantially the same size and shape as the pixel and is located in plate 108 such that its location matches that of its corresponding pixel, so that electrons from the cathode may reach any part of the corresponding phosphor dots in the pixel through such hole and not the insulating layer 113 surrounding such pixel. The wires of electrodes G3 are attached to and placed between spacer plate 108 and spacer structure 107.

As described in more detail below, the inside surface of back plate 110 and the surfaces of elongated spacer members 106 have shadow reducing electrodes 114, 115 respectively for improving brightness uniformity of the display. The outside surface of back plate 110 is attached to printed circuit board 116 to which are soldered input and output leads for the cathode, anode and the three sets of grid electrodes. Cathodes 101 are connected to a current source 150 (connections not shown in FIG. 1A) for heating the cathode filaments. Other than source 150, the drive electronics for device 100 has been omitted to simplify the diagram.

When source 150 supplies current to cathodes 101, the cathode filaments are heated to emit electrons in an electron cloud. The cathodes can also be caused to emit electrons by methods other than by heating, such as in cold cathode emission. This is very different from multiple CRT type devices, where electron beams are generated instead of electron clouds. These electrons in the electron cloud are attracted towards the anode to which a high positive voltage has been applied relative to the cathodes. The paths of electrodes when traveling towards the anode are modulated by voltages applied to the three sets of grid electrodes so that the electrons reach each phosphor dot at the appropriate pixels addressed or scanned for displaying color images.

Figure 2B:
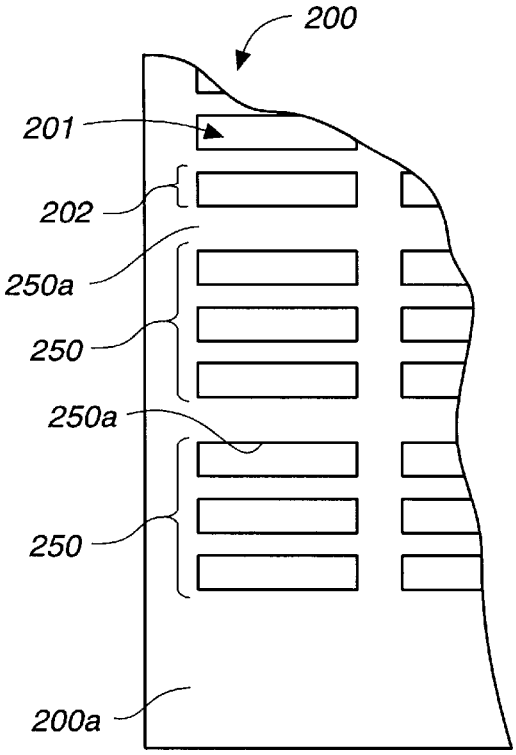
FIG. 2B is a front view of a portion of the spacer plate shown in FIG. 2A.
Figure 2A:
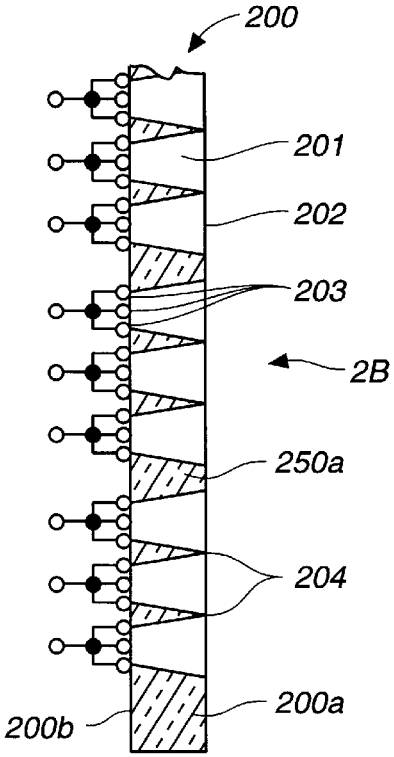
FIG. 2A is a cross-sectional view of a portion of a spacer plate in the device of FIG. 1A and of grid electrodes used for modulating the brightness of the display.

As discussed above, electrical noise and stray electrons in conventional CRT systems frequently cause pixels adjacent to the pixel addressed to become luminescent, resulting in crosstalk and degradation of the performance of the CRT device. Crosstalk is reduced by means of the spacer plate 108 which is shown in more detail in FIGS. 2A, 2B. FIG. 2A is a cross-sectional view of a spacer plate 200 and FIG. 2B is a front view of spacer plate 200 from direction 2B in FIG. 2A, where the electrodes of FIG. 2A have been omitted to simplify the figure in FIG. 2B. The spacer plate 200 is preferably made of a photosensitive glass-ceramic material; in the preferred embodiment plate 200 is made of a lithium silicate glass matrix with potassium and aluminum modifiers sensitized by the addition of trace amounts of silver and cerium. Holes 201 in plate 200 may be formed by photo-etching. Holes 201 may have slanted surfaces so that their ends 202 at the frGnt surface 200*a* are larger than the ends of the holes at the rear surface 200*b* of the plates. The ends 202 of the holes 201 at the front surface 200*a* are each substantially of the same size as its corresponding phosphor or pixel dots where the locations of the holes 201 are such that ends 202 match and overlap substantially its corresponding pixel dots. Holes 201 are substantially rectangular in shape, matching the shape of their corresponding pixel dots.

At the ends of holes 201 at rear surface 200*b* are a number of grid wires 203 (wires in the third set of electrodes 104 in FIG. 1A) substantially parallel to the long sides of holes 201. One or more wires 203 are aligned with each hole; if more than one wire overlaps a hole which is the case shown in FIG. 1A where three wires overlap one hole, the wires overlapping the same hole are electrically connected to form an electrode. Such electrodes formed by one or more grid wires may be used for controlling the brightness of the pixel dot corresponding to such hole by controlling the voltages of the electrode. As shown in FIG. 2B, each pixel 250 may correspond to three adjacent holes 201 corresponding to three phosphor pixel dots with one red, one blue and one green phosphor dot. The arrangement of holes 201 in plate 200 may be viewed as a big hole 250 corresponding to a single pixel of the display, where plate 200 has two separation walls 204 for each hole 250 dividing the hole into three smaller holes 201, each smaller hole matching, overlapping and corresponding to a red, blue or green phosphor dot of the pixel.

Separation walls 204 reduce or eliminate crosstalk between adjacent phosphor dots of the same pixel, so that color purity of the display is much improved. As shown in FIG. 2A, separation walls 204 are wedge-shaped, with the thin end of the wedge facing surface 200*a* to minimize any dark shadows cast by the separation walls on the image displayed. In reference to FIGS. 2A, 1A, electrons originating from cathodes 101 would enter holes 201 through the ends of the holes at the rear surface 200*b* of spacer plate 200 and emerge at ends 202 of the holes. Since ends 202 of the holes overlap and match their corresponding phosphor and pixel dots, the electrons impinge on such dots, causing the appropriate dot addressed to become luminescent for displaying images.

The entire spacer arrangement of the display device of FIG. 1A will now be described by reference to FIGS. 1A and 2A. In reference to FIG. 1A, spacer structures 106 and 107 each comprises a net-shaped structure which may simply be composed of a first array of substantially parallel bars rigidly connected to a second array of substantially parallel bars where the two sets of bars are substantially perpendicular to one another, defining meshes between any pair of adjacent bars in the first set and another pair of adjacent bars in the second set. Preferably, each mesh is large in area to encompass a number of pixels so that electrons passing between the cathodes and anode destined for such pixels will pass through such mesh, where the bars do not block a high percentage of the electrons generated.

The two spacer structures 106, 107 and spacer plate 108 (200 in FIG. 2A) are stacked in such a manner to provide a strong rigid support for the face and back plates 109, 110. As shown in FIG. 1A, wall 250*a* (not so labelled in FIG. 1A) of spacer plate 108 (same as plate 200 of FIG. 2A) is aligned with a bar in structure 107 and another bar in structure 106 as well as with spacer members 111 along a line which is substantially normal to face and back plates where the face and back plates are substantially parallel. In such manner, the aligned portions of spacer plate 108, structures 106, 107 and spacer member 111 abut one another and the face and back plates, forming a support for the face and back plates along a line normal to the face and back plates. Obviously, structures 106, 107, plate 108 and member 111 may include other portions which are not aligned along a line normal to the face and back plates and the face and back plates need not be parallel to each other; all the and may such configurations are within the scope of invention. With such rigid support for the face back plates, the area of the screen of display 100 may be very large while the face and back plates may be made with relatively thin glass. Despite the relatively thin face and back plates, the spacer arrangement described above results in a mechanically strong housing structure adequate for supporting a large screen housing for the display when the housing is evacuated.

To minimize undesirable shadows in the display, rigid support is provided through portions of the spacer plate 108, structures 106, 107 and members 111 that correspond to portions of the screen between adjacent pixels. The thicknesses of wedges 204 at the front surface 200*a* of the spacer plate 200 (108) are smaller than or equal to the separation between adjacent pixel dots. To construct very large screen televisions, for ease of manufacture, spacer plate 108 and spacer structures 106, 107 may be constructed from smaller plates and structures in constructing a larger plate or structure using such smaller plates and structures by placing the smaller plates or structures in the same plane adjacent to one another in a two-dimensional array to form a larger plate or structure.

Figure 3B:
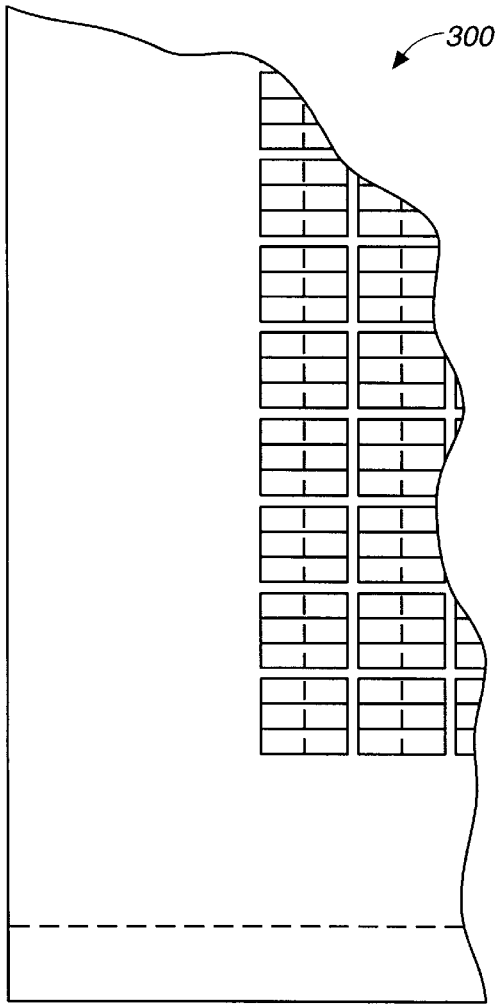
FIG. 3B is a front view of the portion of the device 300 in FIG. 3A.
Figure 3A:
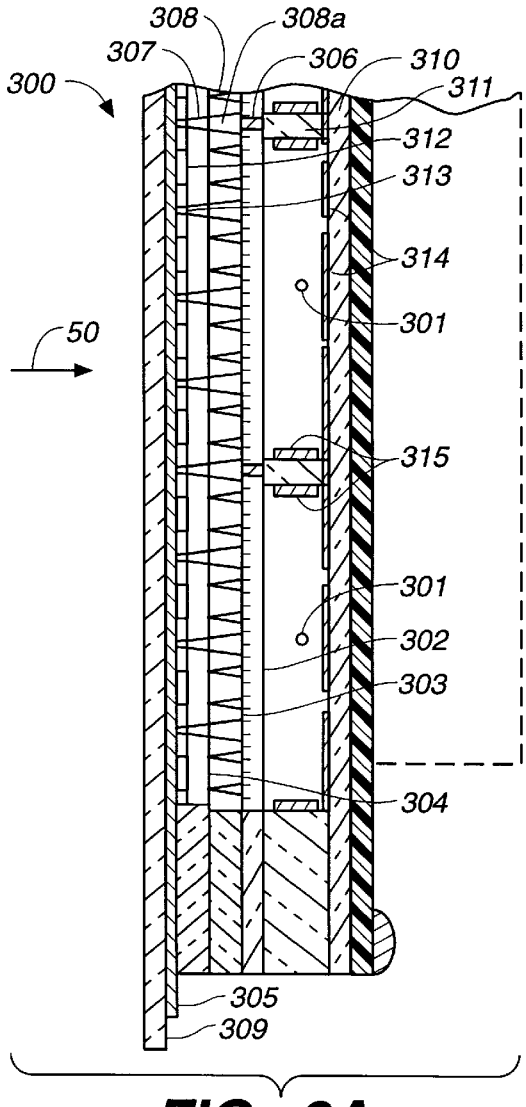
FIG. 3A is a cross-sectional view of a portion of the cathodoluminescent visual display device to illustrate an alternative embodiment of the invention.

FIG. 3A is a cross-sectional view of a portion of a cathodoluminescent visual display device 300 to illustrate an alternative embodiment of the invention. FIG. 3B is a top view of the portion of the device 300 in FIG. 3A. As shown in FIG. 3A, cathodes 301, three sets of grid electrodes 302, 303, 304, anode 305 are enclosed within a chamber between face plate 309 and back plate 310 as in FIG. 3A. Device 300 also includes a spacer plate 308 similar in structure to spacer plate 108 of FIG. 1A and spacer structures 306, 307 similar in structure to structures 106, 107 of FIG. 1A. Device 300 also includes spacer members 311 similar to members 111 of FIG. 1A, where the members 311 are placed alongside cathodes 301 and are connected to the spacer structures 306, 307 and spacer plate 308 in the same manner as in FIG. 1A for providing a rigid support to the face and back plates. Device 300 differs from device 100 of FIG. 1A in that the spacer plate 308 is placed between the second set of grid electrodes 303 (G2) and a third set of grid electrodes 304 (G3) instead of between the third set of grid electrodes and the anode as in device 100; instead, the spacer structure 307 is placed between the third set of grid electrodes and the anode. Thus if the first, second and third sets of grid electrodes are placed respectively in the first, second and third planes between the planes of the face plates 309 and the back plate 310, the spacer plates 108, 308 may be placed between either the plane of the anode and the third plane, or between the third and second planes. Preferably the face and back plates are substantially parallel to one another. Device 300 also differs from device 100 of FIG. 1A in that in device 300, the first and third sets of electrodes 302, 304 are substantially parallel to one another but are substantially perpendicular to electrodes in the second set 303 and to the cathodes 301. In device 100 in FIG. 1A, however, the first and second sets of grid electrodes 103, 102 are substantially parallel to one another but are substantially perpendicular to the third set of grid electrodes 104 and cathodes 101.

As shown in FIG. 3A, the spacer bars in structure 307 are preferably also tapered at substantially the same angle as the tapering dividing members between pixels in spacer plate 308 and are aligned therewith and are of such widths as shown ln FIG. 3A so that these spacer bars and the walls 308*a* between the holes (similar to wall 250*a* of FIG. 2A) in the spacer plates 308 form an essentially smooth tapering surface to maximize the number of electrons that can be transmitted therethrough and to minimize the dark areas caused by the spacer arrangement. As in device 100, spacer plate 308 and spacer structures 306, 307 and spacer members 311 all have at least one portion along a line normal to the face and back plates abutting each other and the face and back plates to provide rigid mechanical support for the face and back plates when the chamber between the face and back plates is evacuated.

Figure 3C:
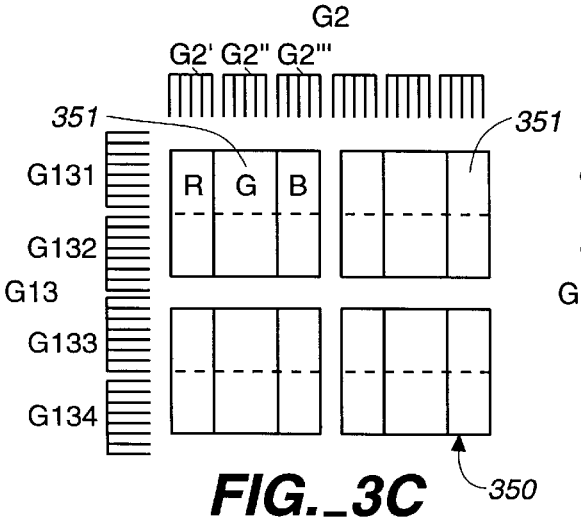
FIG. 3C is a schematic view of an arrangement of the pixel dots in a pixel.

FIG. 3C is a schematic view of four pixels 350 each ineluding three pixel dots 351 and their respective control grid electrodes for controlling the scanning and brightness of these pixels. Instead of having three wires overlapping each hole 201 corresponding to each pixel dot as shown in FIG. 2A, each of the groups G2', G2" and G2"' includes five wires electrically connected and overlapping each pixel dot 351 (corresponding to each hole 201 of FIG. 2A) for controlling the brightness of the pixel dot that overlaps and matches such hole. As shown in FIG. 3C, the top half of each pixel is addressed by one group of scan lines, such as lines G131, and the bottom half by scan lines G132. While both the upper and lower halves of the pixel 350 may be scanned at the same time by applying identical voltages to the two groups of wires G131, G132, the two halves of the pixel may be addressed separately and treated essentially as two different pixels to increase resolution.

Figure 3D:
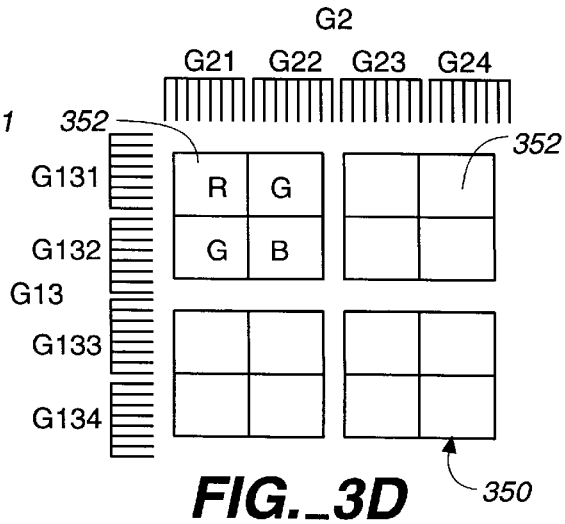
FIG. 3D is a schematic view of another arrangement of pixel dots within a pixel.

FIG. 3D is a schematic view of four pixels 350' each including four pixel dots 352 and the control grid lines for scanning and controlling the brightness of these pixels 352 to illustrate an alternative embodiment of the invention. As shown in FIG. 3D, each of the follr pixels 350' includes a red, a blue and two green pixel dots 352. In such event, the group of electrodes for scanning the pixels should cause all four pixel dots to be scanned in order for the pixel to provide the desired correct illumination. Where the scheme of FIG. 3D is used, each hole in the spacer plate 108, 200 or 308 in FIGS. 1A, 2A or 3A should be divided by two substantially perpendicular separating walls into four smaller holes aligned with and overlapping one of the four pixel dots 352 of each pixel 350' in FIG. 3D. Obviously, other arrangements of pixel dots in the pixel may be used and other arrangements of separating walls dividing each larger hole 250 corresponding to a pixel into smaller holes matching such pixel dot arrangements may be used and are within the scope of the invention.

As shown in FIGS. 1A, 3A, spacer members 111, 311 are thicker than the bars in structures 106, 107 and 306, 307 respectively. In order to reduce any dark shadows caused by spacer structures 106, 107, 306, 307, the grid electrodes close to the bars of these structures are spaced apart at closer spacings than those further away from the bars. For the same reason, higher electrical potentials may be applied to the grid electrodes closer to the bars than those applied to the grid electrodes further away from the bars. Both features would tend to cause a greater percentage of the electrons generated by the cathode to impinge upon portions of the pixel dots that are closer to the bars, thereby compensating for the effect of the bars in blocking the electrons.

With the spacer means described above, the face and back plates may be made of glass plates that are less than about 1 mm in thickness. The grid electrodes in each of the three sets may be made of gold-plated tungsten wires of cross-sectional dimensions greater than about 5 microns. The holes 201 of FIG. 2A have dimensions greater than about 0.2 millimeters. While multi-colored phosphors are illustrated in FIGS. 3C, 3D, it will be understood that monochrome phosphors may also be used for monochrome display and is within the scope of the invention.

The sharpness and resolution of the images displayed are dependent upon the relative directions of the three sets of grid electrodes and of the cathode filaments. The four arrangements described below achieve acceptable resolution and focusing:

1. The cathode filaments are placed horizontally substantially parallel to the first and second sets of grid electrodes G1, G2. The first and second sets of grid electrodes G1, G2 are used for line scanning. The third set of grid electrodes G3 is perpendicular to the first and second sets and is used for modulating brightness of the pixel dots that are scanned.
2. The cathode filaments are placed horizontally and substantially parallel to the first and third sets of grid electrodes G1, G3; the first and third sets of grid electrodes G1, G3 are used for line scanning. The second set of grid electrodes G2 is substantially perpendicular to those of the first and third sets and is used for modulating the brightness cf the pixel dots.
3. The cathode filaments are placed substantially vertically and are substantially perpendicular to the first and second sets of grid electrodes G1, G2; the first and second sets of grid electrodes are used for line scanning. The third set of grid electrodes G3 is substantially perpendicular to the first and second sets and is used for modulating brightness of the pixel dots.
4. The cathode filaments are placed substantially vertically and are substantially perpendicular to the first and third sets of grid electrodes; the first and third sets of grid electrodes G1, G3 are used for line scanning. The second set cf grid electrodes G2 is substantially normal to the first and third sets and is used for modulating pixel dot brightness.

It may be preferable for the cathode filaments to be placed vertically to reduce sagging. The second and fourth electrode arrangements of using the first and third groups of grid electrodes for line scanning and a second set of grid electrodes for modulating pixel dot brightness have the advantages of low modulating voltages, low currents, and simple driving circuits.

Devices 100, 300 of FIGS. 1A, 3A may be simplified by using only two sets of grid electrodes instead of three, such as by eliminating the third set of grid electrodes 104, 304 respectively. In such event, to retain good resolution and focusing properties, the first set of grid electrodes 103, 302 are parallel to the cathode filaments and arranged in the following manner:

1. The cathode filaments are placed horizontally and substantially parallel to the first set of grid electrodes where the first set of grid electrodes G1 are used for line scanning. The second set of grid electrodes 102, 303 is substantially perpendicular to the first set of grid electrodes are are used for modulating brightness of the pixel dots.
2. The cathode filaments are vertically placed parallel to the first set of grid electrodes where the first set of grid electrodes G1 are used for modulating brightness. The second set of grid electrodes G2 is substantially perpendicular to the first set and is used for line scanning.

In the embodiments described above, different spacer arrangements are used to provide mechanical support for the face and back plates when the chamber enclosed by these plates is evacuated. The spacers may in some instances become obstacles to electrons emitted by the cathodes and cause dark areas in the cathodoluminescent visual display which is undesirable. To reduce or even eliminate such dark areas, the electric field surrounding the cathode filaments is altered to cause a greater number of electrons to impinge portions of the phosphor dots that are closer to the spacer elements than portions of the pixel dots further away from such spacer elements.

Figure 4:
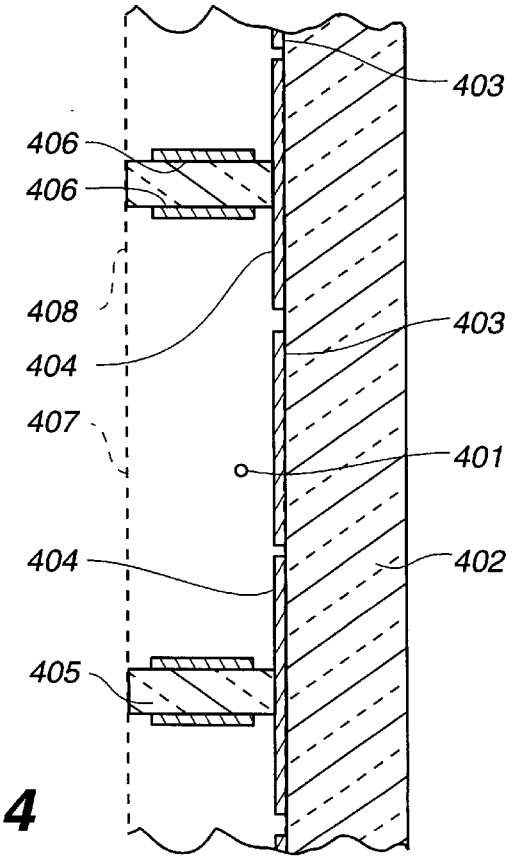
FIG. 4 is a cross-sectional view of a portion of the device of FIGS. 1A and 3A to illustrate the invention.

FIG. 4 is a cross-sectional view of a back portion of the devices 100, 300 of FIGS. 1A, 3A to illustrate one such scheme for all three electric fields surrounding the cathode filaments. In FIG. 4, 401 is a cathode filament. The inside surface of back plate 402 has a conductive layer divided into two groups: 403 and 404. The group of electrodes 403 directly faces the filament and therefore overlap the cathode filaments; the voltage applied to electrodes 403 is the same as that applied to the cathode filaments 401. Electrodes 404 do not overlap cathodes 401. Appropriate voltages are applied to electrodes 404 so that they are at a high electrical potential compared to cathode filaments 401 and electrodes 403 so that they would tend to attract electrons emitted by the filaments 401, causing more electrons to impinge phosphor dots on the anode at locations closer to spacer members 405. In the preferred embodiment, both groups of electrodes 403, 404 are substantially parallel to the cathode filaments 401 and effectively reduce shadows caused by the presence of spacer members 405 at the spacer bars 106, 107, 306, 307 also parallel to the cathode filaments.

An additional set of electrodes 406 present on both sides of spacer members 405 is also caused to be at higher electrical potentials compared to cathode filaments 401 to further attract electrons emitted by the cathode filament and cause them to travel in directions closer to spacer members 405 so as to reduce the shadows caused by the spacer members.

The first set of electrodes comprising electrodes 407, 408 are also spaced apart by such spacings as to cause more electrons to travel closer to the spacer members 406. This is achieved by causing the grid wires 408 to be at closer spacings at locations closer to the spacer members than grid wires 407 at locations further away from the spacer members. As shown in FIG. 4 this is illustrated by locating the grid electrodes so that the electrodes 408 are closer together than electrodes 407.

Yet another technique for reducing shadows caused by spacer members 406 is to apply voltages such that grid electrodes 408 are at higher electrical potentials than grid electrodes 407. The last described method concerning the grid electrodes may also be used for reducing shadows caused by spacer bars which are transverse to the cathode filament 401 by causing grid electrodes parallel to such bars to be at closer spacings at locations close to such spacer bars than at locations further away from such spacer bars and/or by applying higher voltages to such grid electrodes closer to the spacer bars than voltages applied to grid electrodes further away from the spacer bars.

The above description is taken essentially from parent application Ser. No. 08/070,343.

The description of the one piece core multiple electrode and its processing methodologies unique to this application is set forth below beginning with FIG. 5A. The key features of the simplified electrode structure include the following: (1) There is only one spacer structure within the isolated chamber, thereby reducing complicated alignment during device assembly; (2) the spacer structure is in contact with the anode plate to eliminate wall charging effect; (3) thin separation walls are used to separate electrons directed to the three phosphor dots to eliminate crosstalk between the three colors thereby enhancing the color purity of the display device; (4) thin conducting film is directly deposited onto the inner surface of the thin spacer walls to provide low operating voltage range of electrode even when anode is maintained at high voltage; (5) electron shaping electrodes are formed near the cathode to provide uniform electron emission from filaments thereby enhancing brightness uniformity; (6) the use of only one spacer structure to provide ease of large volume production since the multiple electrodes can be fabricated in steps with self-aligned features thereby reducing complicated alignment procedures during the assembly of the device; (7) the use of a back plate with array of pillars that function both as alignment registration mark and reinforcement allows large area thin glass plate to withstand a full atmospheric pressure difference. While the above features can be advantageously used in the same device, each of them can be used independently of any other feature. All of these improvements made in the structural design of the multiple electrodes in EFD device permit the fabrication of large-area EFD display device (over 40 inches) using currently available cost-effective manufacturing processes.

Figure 5A:
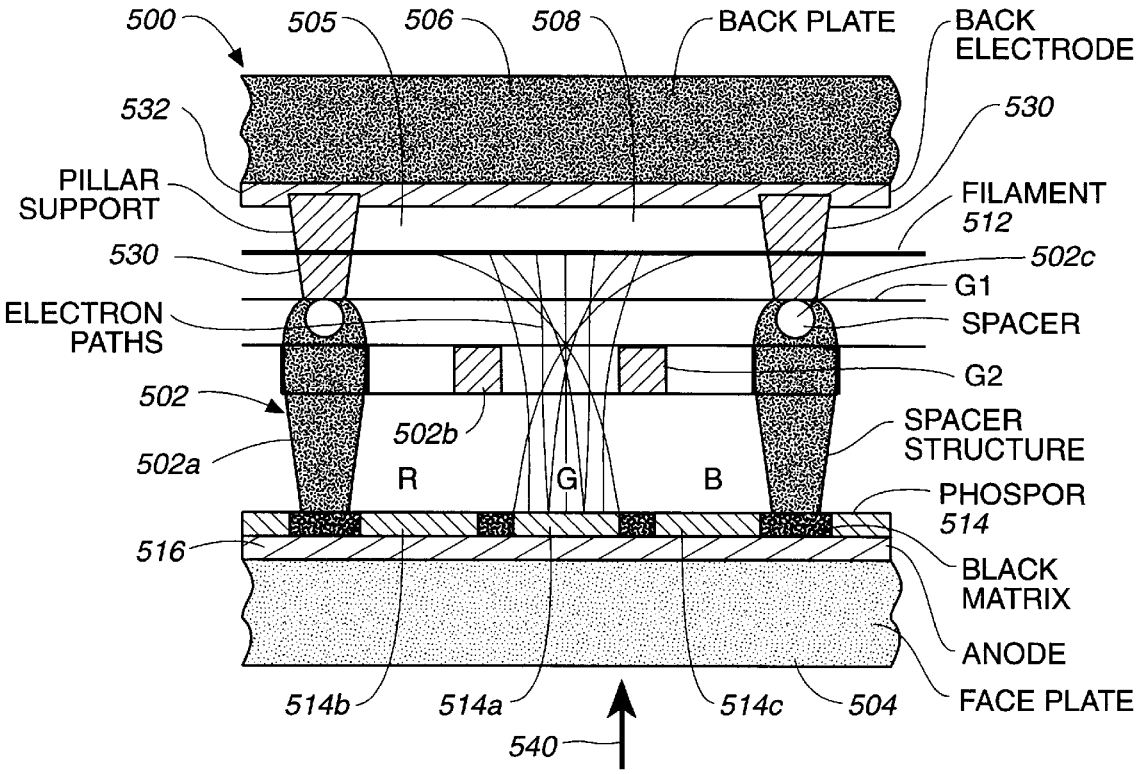
FIG. 5A is a cross-sectional view of a portion of a cathodoluminescent visual display device to illustrate the preferred embodiment of the simplified electrode structure in the electronic fluorescent display (EFD) device using the two-layer spacer structure.

Referring to FIG. 5A, a preferred embodiment of the cathodoluminescent device is illustrated. FIG. 5A is a cross-sectional view of device 500 with one piece core multiple electrode structure 502, that is, an integral or unitary spacer structure 502. The embodiment includes a face plate 504 and a back plate 506 and optional side walls (not shown) that form a housing to enclose within chamber 508 one or more cathodes 512, two sets of grid electrodes G1 and G2, in which G2 is preferably deposited on the inside walls of the support and/or separation partitions of the spacer structure. In other words, spacer structure 502 has holes therein, where G2 is deposited on the inside surfaces of the holes. These electrodes and components are sealed in chamber 508 at the peripheral or side walls of the device to form a flat vacuum device. The chamber of the device enclosed by the peripheral of the plates is evacuated so that the electrons generated at the cathodes travel freely toward the anode in a manner described below.

As shown in FIG. 5A, spacer structure 502 is rigidly and securely connected (i.e. attached) to the two sets of grid electrodes G1 and G2. Structure 502 includes support walls 502*a* and separation walls 502*b* and separation spacers 502*c* between the set of grid electrodes G1 and the set of grid electrodes G2. Each of one or more cathode filaments 512 is caused to generate electrons that form an electron cloud in chamber 508. Appropriate voltages are then applied to grid electrodes G1, G2 to direct the electrons in the electron cloud towards the appropriate phosphor dots on the phosphor layer 514 placed on top of the anode 516. In the scheme shown in FIG. 5A, the voltages applied to the set of grid electrodes G1 are used for scanning and the voltages applied to grid electrodes G2 are used for electron focusing to obtain high resolution with appropriate thickness of layer 1 in FIG. 6 described below and applied voltage. Thus, with appropriate voltages applied to G2, G1, and appropriate thickness of layer 1, which preferably has a thickness in the range of 0.2 to 30 mm., the electrons passing through a hole in structure 502 through a G2 electrode coating on the inside surface of the hole (such as a rectangular ring-shaped G2 coating the surface of the hole) will cause electrons passing therethrough to focus onto the overlapping pixel dot. Such focusing effect is shown in FIG. 5A. Therefore, the G2 electrodes also preferably have thicknesses (that is, the dimensions perpendicular to the anode) of between about 0.2 to 30 mm. Other than rectangular in shape, the holes in structure 502 and the G2 electrodes may also have elliptical, circular, square, hexagonal, octagonal or other polygonal shapes depending on the size and applied voltage for efficient focusing mechanism. The voltages applied to G2 are also used for controlling the brightness of the three colors: red, green and blue. In the instance shown in FIG. 5A, where it is intended that the green pixel dot 514*a* on the phosphor layer should emit light, the electrical potentials applied to grid electrodes G2 on the support and separation walls are such that the electrons from the electron cloud are focused between the two separation walls towards phosphor dot 514*a*.

Figure 5B:
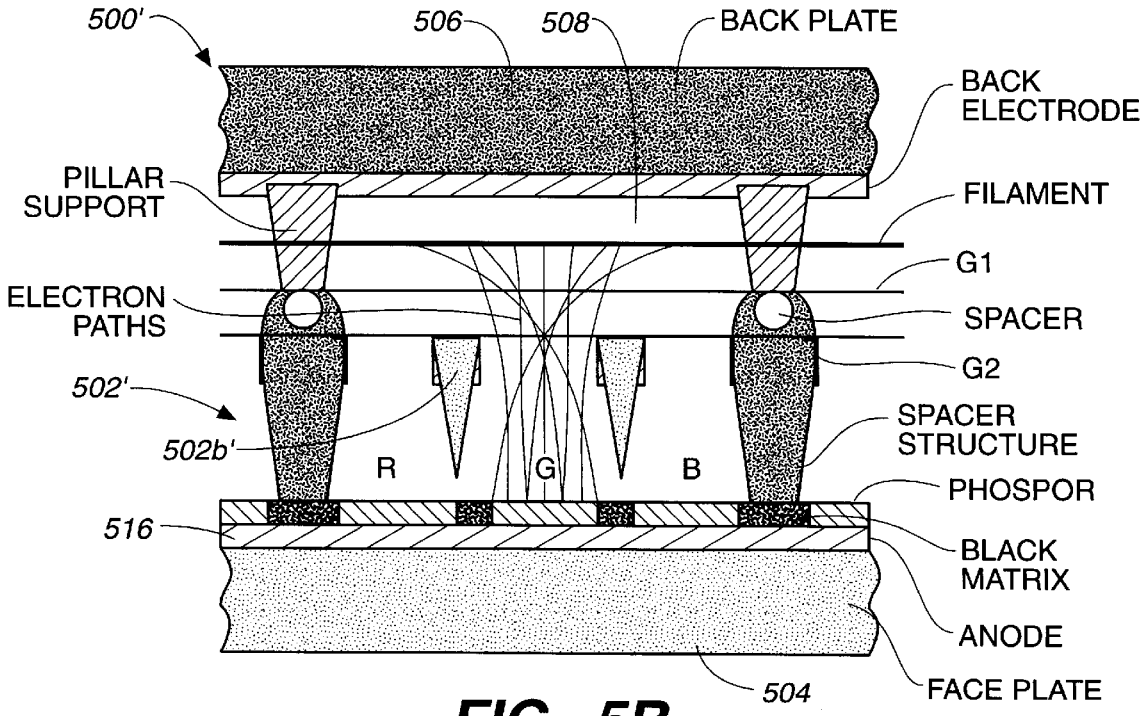
FIG. 5B is a cross-sectional view of a portion of a cathodoluminescent visual display device to illustrate an alternative embodiment of the simplified electrode structure in the electronic fluorescent display (EFD) device.
Figure 12:
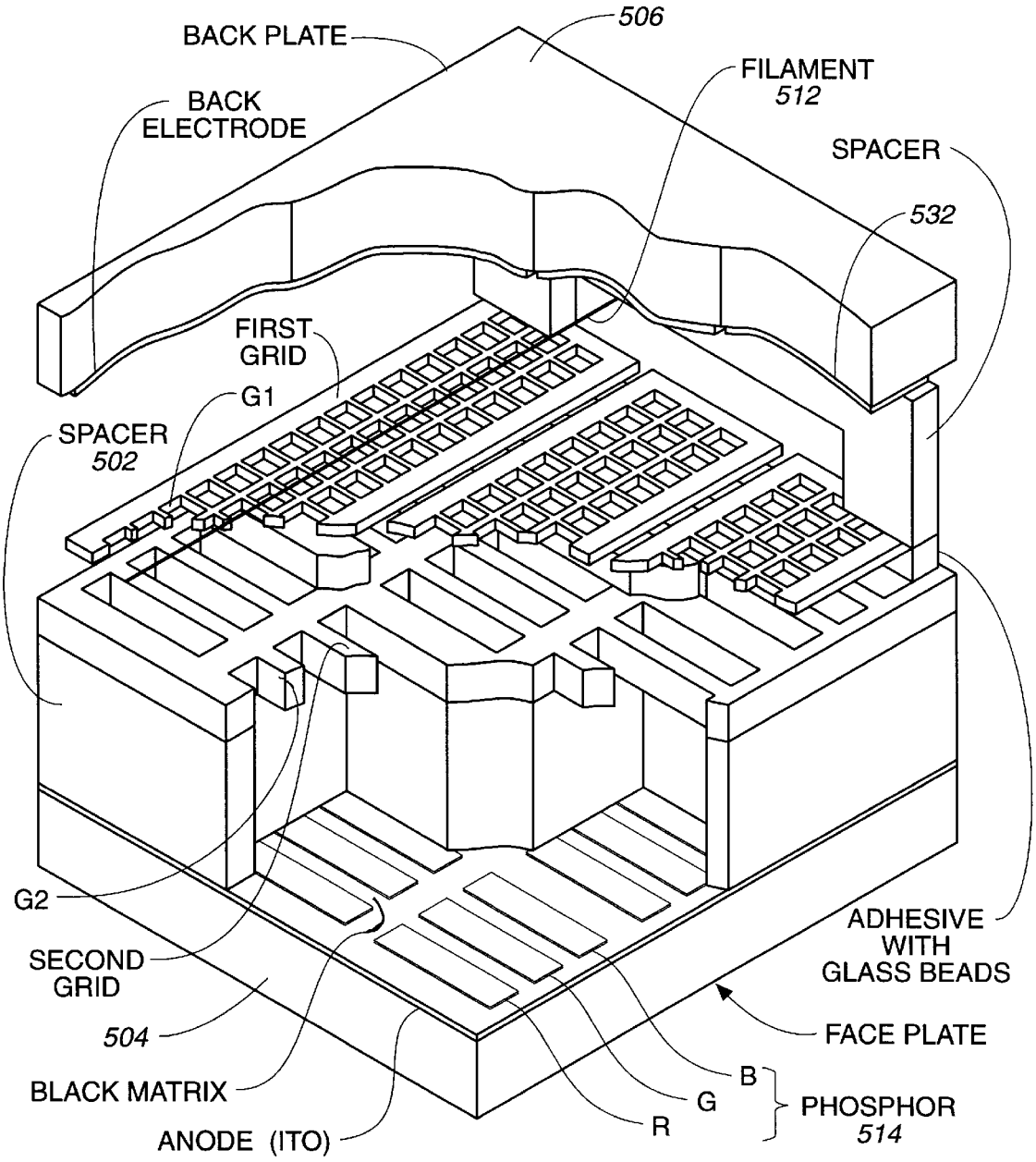
FIG. 12 is a cut away perspective view of the device of FIG. 5A to illustrate the invention.

FIG. 5B is a cross-sectional view of a portion of a cathodoluminescent visual display device or EFD to illustrate an alternative embodiment of the device employing a simplified electrode structure slightly different from that in FIG. 5A. The device 500' of FIG. 5B differs from device 500 of FIG. 5A only in that the separation walls 502*b*' of device 500' have a tapered or wedge-shaped cross-section rather than a square or rectangular cross-section such as separation walls 502*b* of device 500 in FIG. 5A. The tapered separation walls may be formed by attached corresponding tapered separation portions of two layers similar to the layers in FIG. 6. A partially cutaway perspective view of device 500 is shown in FIG. 12.

Figure 6:
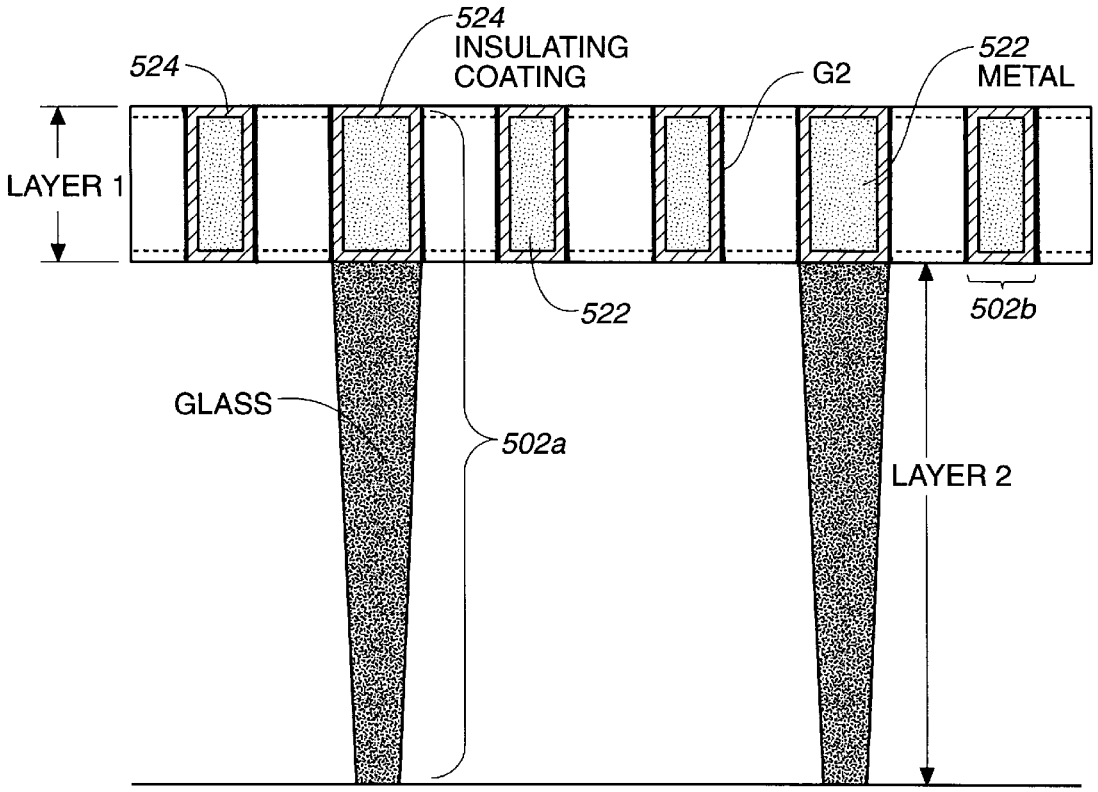
FIG. 6 is a cross-sectional view of a portion of the preferred embodiment of the one piece core multiple electrode spacer of FIG. 5A where the spacer contains a two-layer spacer plate.

Referring to FIG. 6, the spacer plate portion of the spacer structure in the preferred embodiment shown in FIG. 5A includes two layers. The top layer (layer 1) may be made of a metal sheet or foil substrate form 522 with holes therein separated by partitions formed in a number of ways including chemical etching with a photomask, stamping and electroforming. The metal form 522 may be coated with a layer of insulating material 524 by various coating processes such as, but not limited to, dip-coating and evaporated coating techniques. Alternatively, layer 1 may be made of glass or a ceramic material, in which case it is not necessary to coat it with an insulating material. The support form (layer 2) of the spacer structure may be made of glass or ceramic and the array of openings may be formed by a number of processing techniques but not limited to sandblasting, ultrasonic machining and chemical etching. The glass or ceramic material used for the support structure (layer 2) may be selected with the proper volume resistivity to reduce the charging effect. In this way, the expensive coating process commonly used to coat insulating material with high resistive coating is totally eliminated. The two layers are attached or securely joined together, such as by means of an adhesive, to form the spacer plate which is a part of the one piece core multiple electrode spacer structure 502. As shown in FIGS. 5A, 6, layer 1 has thicker portions that match those of layer 2, where such matching portions join together to form the support walls 502*a* of the spacer structure of FIG. 5A, whereas the thinner separation portions of layer 1 form the separation walls 502*b* of the spacer structure. Grid electrodes G2 are electrically conductive layers deposited on inside surfaces of the holes in layer 1.

The cathodes 512 form a group of substantially parallel direct heated oxide coated filaments arranged in short segments mounted on the back plate having an array of pillar support and a pattern of conductive film. Again, other techniques for causing the cathodes may also be used and are within the scope of the invention. Where the device 500 is smaller (e.g. 4 in), no support between the face and back plates other than at the edges is necessary. However, for larger devices, such as up to those of 41 inches or above, an array of pillar supports or pillars 530 on the back plate is used to strengthen the large device structure when it is evacuated to high vacuum. In the preferred embodiment, these pillars are attached to the spacer structure but cover no more than 15% of the effective (explained below) area of the spacer structure or plate. A conducting film on the back plate and shaped into a specific electrode pattern such as one in the form of elongated strips 532 parallel to the cathode filaments 512 is employed to enhance uniformity of emitted electrons from the filaments traveling towards the viewing direction by shaping paths of electrons traveling from the cathodes to the anode and are also referred to below as electron shaping electrodes.

The filaments are mounted in multiples of short segments to minimize vibration and sagging during operation in particular for large-area display device. FIG. 5A shows the arrangement of the filaments, the back electrode and one pillar of the array of pillars on the back plate. The pattern of electron shaping electrodes is shown more clearly in FIGS. 8B, 10A described below.

In the preferred embodiment in FIG. 5A, only a one piece core multiple electrode structure is used, thereby eliminating numerous tedious alignment and spacer structure placement steps in the assembly process of EFD device. Electrode G2 on the spacer structure is deposited thereon either by evaporating thin film or by selective plating of the appropriate metal. Such arrangement of the grid electrodes onto a rigid insulating metal form eliminates the use of anchors to reduce the amplitude of vibrations resulting from the movement of the large device. Between the first set of grid electrodes G1 and the second set of electrodes G2 on the spacer plate are separation spacers which may be directly fabricated onto layer 1 of the spacer plate portion of the spacer strucutre 502. The separation spacers 502*c* are formed by controlled dimension glass beads blended in high temperature adhesive. Using such fabrication technique allows precise control of the spacer separation between G1, G2 for a large-area display.

The G1 grid electrode may be patterned, for example, by chemical etching, electroforming, and fine pitch screen printing. To facilitate the control of electron passage through the device, the spacing between the two sets of grid electrodes G1 and G2 has to be precisely defined. The precise spacing between G1 and G2 electrodes is formed by applying the high temperature adhesive blend to the G1 grid electrode mesh and the resulting G1 grid electrode assembly is then securely attached to the spacer structure by curing to form the one piece core multiple electrode spacer 502 in the present preferred embodiment. The forming of the one piece core multiple electrode structure thereby eliminates the use of multiple spacers as well as numerous precise alignment steps in the assembly of the electronic fluorescent display device. Eliminating some of the critical assembly steps thereby permits cost-effective manufacturing of very large-area display.

On the inside surface of the face plate is the anode comprising a layer of conductive film having three low voltage primary color (R, B, G) cathodoluminescent phosphor dots, and black matrix layer between the phosphor to enhance contrast for each color pixel. Between the anode and the cathode is a one piece core multiple electrode structure 502 to control the course of electron passage. The spacer structure has array of holes therein, where the holes overlap and match the phosphor dots and anode. The arrangement is such that each hole in the spacer structure corresponds to a small number of a predetermined group of pixel dots forming a pixel, and has substantially the same size and shape as the pixel such that its location matches that of its corresponding pixel, so that electrons from the cathode may reach any part of the corresponding dots in the pixel through such hole and not in the black matrix insulating layer surrounding the pixel. Thus, as shown in FIG. 5A, the hole in structure between the support walls 502*a* matches the pixel with pixel dots 514*a,* 514*b,* 514*c.* Separation walls 502*b* divides such hole in structure 502 into smaller holes each matching or overlapping a corresponding pixel dot when viewed in the viewing direction 540.

The control grid electrodes G2 are directly deposited on the insulating coating on metal form layer 1. Preferably, the insulating support layer 2 in FIG. 6 having multiple compartments separated by thin walls is made out of high resistive materials employing a combination of pattern generation processes and air abrasive techniques. In this way, the overall size limitation imposed by the use of photosensitive glass ceramic has been totally eliminated, thereby allowing the fabrication of large-area display device.

Figure 7:
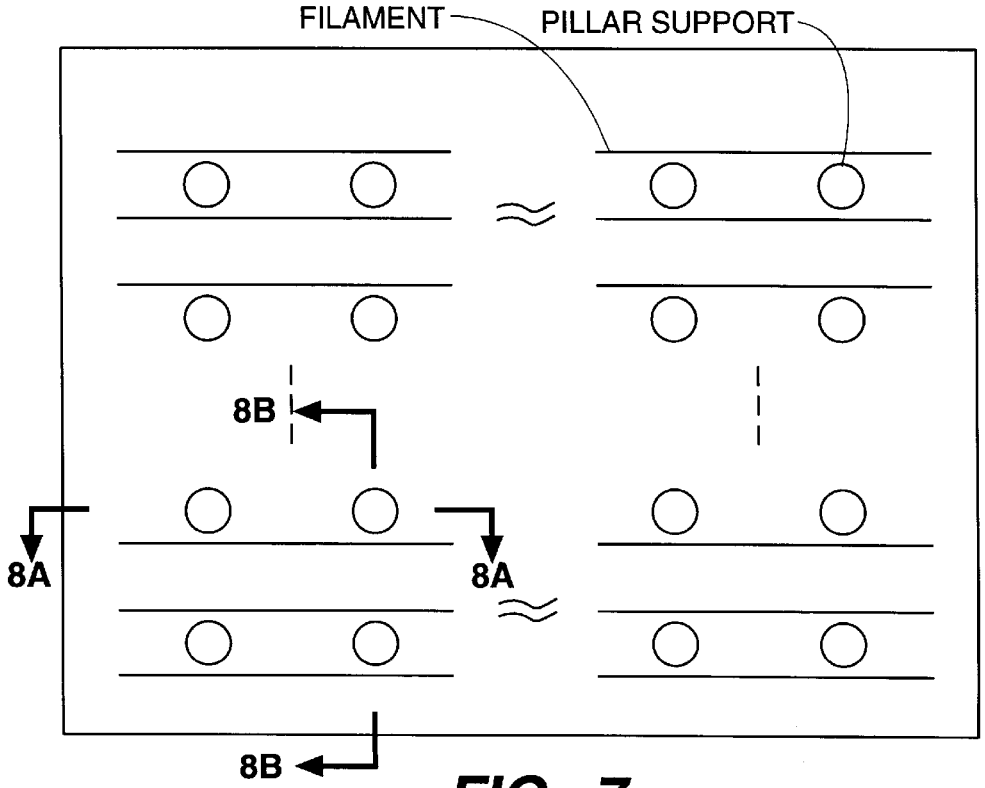
FIG. 7 is a schematic view of a large-area EFD display illustrating the use of an array of pillars to improve the mechanical strength of the large-area face plate.
Figure 8A:
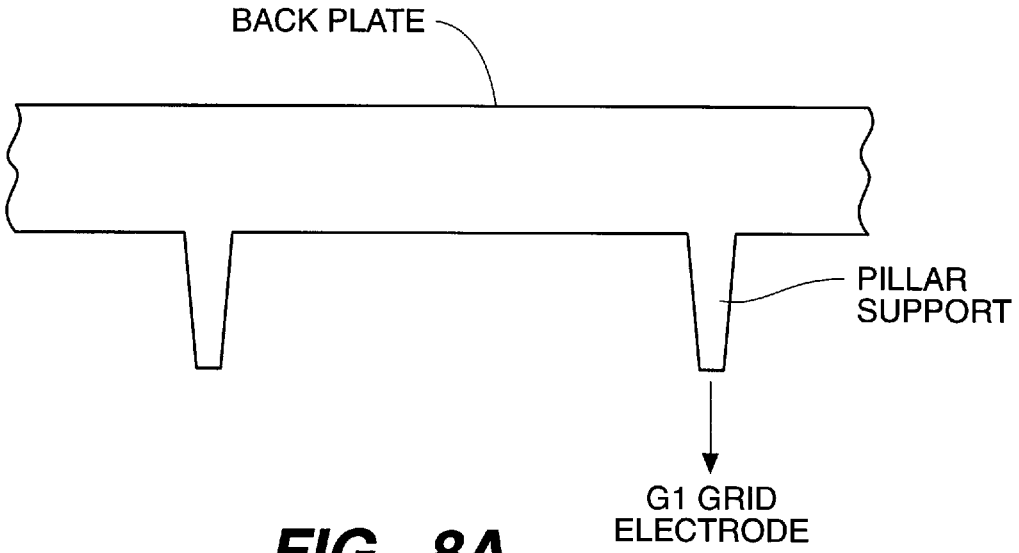
FIG. 8A is a cross-sectional view of the cathode plate of FIG. 7 along the line 8A—8A illustrating the pillar support.
Figure 8B:
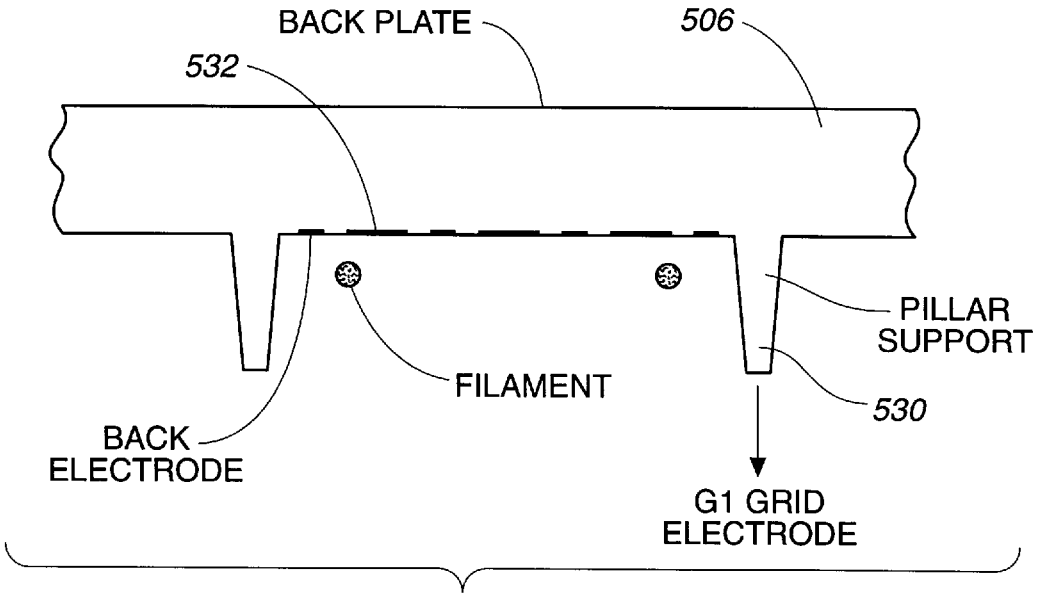
FIG. 8B is a cross-sectional view of the cathode plate of FIG. 7 taken along the line 8B—8B illustrating the pillar support, the set of electron shaping electrodes in relation to the location of filament.

The inside surface of back plate 506 has an array of pillar supports 530 for fixation of grid electrode G1, and for strengthening of a large-area display device, and has electron shaping electrodes 532 for improving brightness uniformity of the display. The peripheral of the large-area device is attached to a printed circuit board (not shown) to which the input and output leads for the cathode, anode and the two sets of grid electrodes are connected to the current source and drive electronics (not shown). FIG. 7 and the cross-sectional views in FIGS. 8A, 8B illustrate more clearly the pillars 530 on the back plate.

When the current source supplies current to the cathodes, the filaments are heated to emit electrons in the form of an electron cloud. This is very different from multiple CRT type display devices where electron beams are generated instead of electron clouds. In CRT type devices, electrons are focused or passed through small holes to form a beam, and the beam is then deflected by means of deflection electrodes.

Figure 10A:
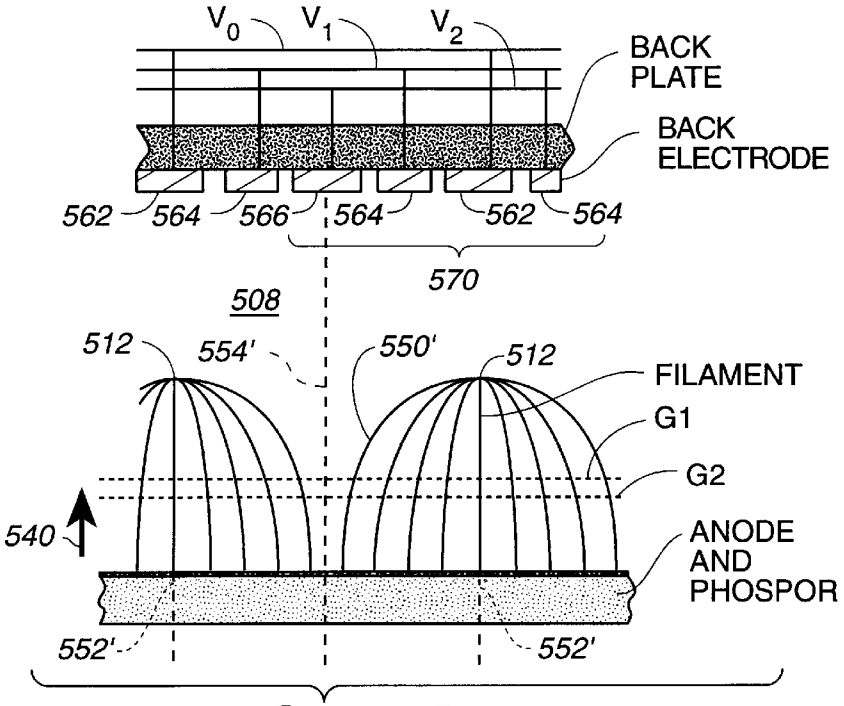
FIG. 10A is a schematic view of filament and grid electrode arrangement and electron shaping electrodes in a cathodoluminescent visual display device illustrating the effect of the electron shaping electrodes on the emitted electrons from the filaments.
Figure 9A:
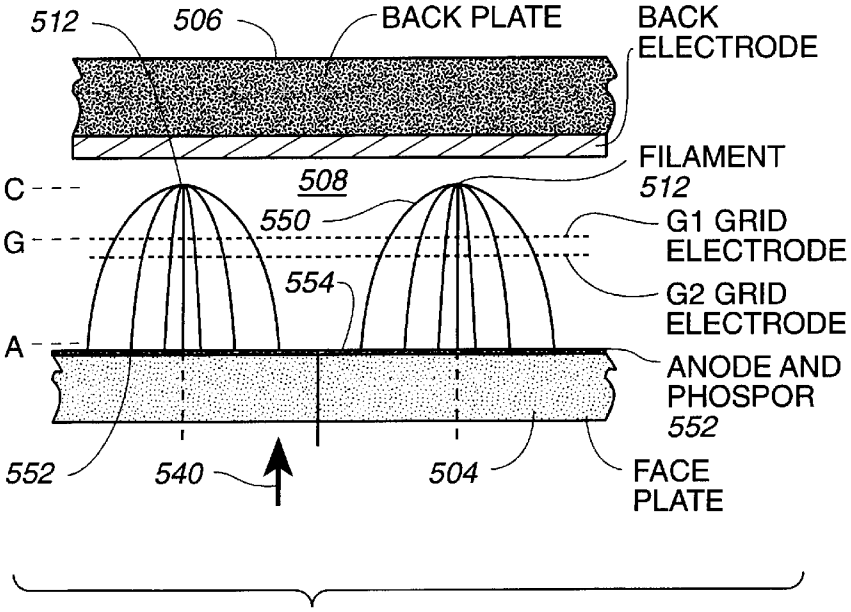
FIG. 9A is a schematic view of filament and grid electrode arrangement in a cathodoluminescent visual display device illustrating the spreading of electrons to form an electron cloud in an EFD device.
Figure 9B:
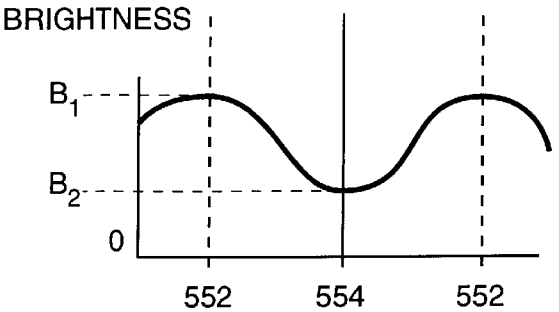
FIG. 9B is a graphical illustration of the brightness of the display of the device in FIG. 9A.

In reference to FIG. 9A, the cathode filaments 512 lie in the cathode plane C and the anode surface impinged by electrons lie in an anode plane A and a set of grid electrodes G1 closer to the cathode plane than the grid electrodes G2 lie in the grid plane G. In the preferred embodiment, the three planes A, G, C are substantially parallel. As shown in FIG. 9A, because of the mutual repulsion of electrons, once they are emitted by the filaments 512, they will tend to spread out in all directions to form an electron cloud. In a CRT-type device, attempt is then made to focus or concentrate the electrons into a narrow beam in a direction more or less perpendicular to the anode. In contrast, in the cathodoluminescent devices of this invention, the electrons are allowed to spread in all directions, including lateral directions not perpendicular to plane A before they are caused to travel towards the anode by applying suitable electrical potentials to the cathode filaments, the two sets of grid electrodes, and the anode. These electron paths are illustrated by lines 550 in FIG. 9A. For simplicity, the spacer structure 502 has been omitted from FIG. 9A. As shown in FIGS. 5A, 9A, the paths of electrons from the cathode filaments 512 to the anode 516 are impeded only by the two sets of grid electrodes and the spacer structure 502. Except for such impediment, the electrons are free to spread throughout chamber 508, particularly in the space between the back plate 506 and plane G. When electrons get closer to plane G, the influence of the potentials on the grid electrodes and anode on such electrons will cause them to accelerate towards the anode as shown by paths 550. In the preferred embodiment, the distance between the plane of the cathode filament C to the closest grid plane G is at least 5% or more of the distance between the cathode plane C and the anode plane A. Especially where electron shaping electrodes are also used to help the lateral spreading of the electrons as shown in FIG. 10A, this will ensure that electrons emitted by the filament will have spread adequately in lateral directions parallel or at small angles to plane A before they are accelerated towards the anode to achieve a display of uniform brightness. As shown in FIG. 9A, if two adjacent cathode filaments are spaced apart by a significant distance, the portion 554 of the anode and phosphor that overlaps the region halfway between the two filaments when viewed in the viewing direction 540 will receive fewer number of electrons and will therefore emit light of lower intensity compared to areas 552 that overlap the two filaments when viewed along 540 as illustrated in FIG. 9A. FIG. 9B is a graphical illustration of brightness of the portion of the display in FIG. 9A where the brightness across the plane A in FIG. 9A is shown. Thus, as shown in FIGS. 9A, 9B, the brightness of the display will be at a maximum B1 at locations 552 that directly overlap the cathode filaments and at a minimum B2 at areas 554 that overlap the space halfway between two adjacent filaments. Nevertheless, as compared to CRT devices, the advantage of the EFD device illustrated in FIGS. 9A, 9B is that most of the electrons generated by filaments 512 are directed towards the anode and phosphor for generating light as compared to only a small fraction of the electrons generated in CRT-type devices. Thus in certain CRT-type devices, in order to form electron beams of narrow cross-sections, electrons generated by filaments are passed through spacers having small holes. In this manner, the great majority of the electrons generated by the filaments are lost and only a small fraction will pass through the holes. In the invention of this application, however, the size of the holes in the spacer structure are maximized in order to increase the percentage of electrons that are allowed to pass from cathodes to the anode. In the preferred embodiment, the spacer structure or plate blocking passage of such electrons occupy less than 80% of the effective area of the spacer plate. In other words, the osmotic coefficient of the device is more than 20%. In this context, the effective area of the spacer plate is defined as the area over which holes are distributed through which electrons can pass through from the cathodes to the anode when a full range of addressing and scanning electrical potentials are applied to the cathodes, anode and grid electrodes. In other words, if a display device happens to have an area devoid of cathodes or grid electrodes or holes in the spacer that permit passage of electrons, such area would not be part of the effective area of the spacer plate. Stated in another way, the effective area of the spacer structure or plate is defined as the area over which through holes are distributed where electrons from electron cloud emitted by the cathode filaments are channeled when suitable electrical potentials are applied to the anode, cathodes and grid electrodes.

To further reduce impediments for lateral spreading of electrons emitted by the cathodes, the number of pillars 530 is minimized. As indicated above, devices with screens less than 4 inches do not need pillars. For larger devices, pillars are needed only at spacings of about 1 to 100 mm. apart so that for a device with a 41 inch screen, pillars will be needed to counteract atmospheric pressure despite a high vacuum in chamber 508.

As illustrated in FIGS. 9A, 9B, where adjacent cathode filaments 512 are separated by significant distances, areas of the anode corresponding to the space between adjacent filaments may emit less light than other areas, causing non-uniformity of brightness of the display. This can be remedied by increasing the density of cathode filaments. Increasing filament density, however, has the undesirable effect of increasing the current drawn by the device and hence the overall power consumption. Brightness uniformity can also be improved without increasing power consumption by electron shaping electrodes in a scheme shown in FIGS. 10A, 10B. FIG. 10A shows an EFD structure similar to that in FIG. 9A, except that the back electrode is an electrically conductive film forming a pattern of an array of parallel elongated strips parallel to the cathode filaments.

Figure 10B:
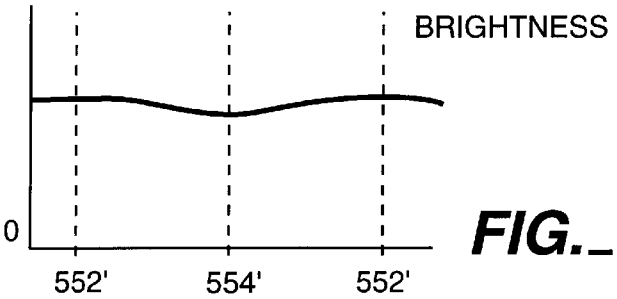
FIG. 10B is a graphical illustration of the brightness of the display of the device in FIG. 10A.

FIG. 10A is a cross-sectional view of a portion of device 500 where the spacer structure has been omitted to simplify the drawing, where the back electrode is in the form of a layer of parallel elongated strips forming an array parallel to the cathode filaments 512. As shown in FIG. 10A, some electron shaping electrodes 562, 566 are wider than other electron shaping electrodes 564 arranged so that each adjacent pair of wider electrodes 562, 566 is separated by a narrow electrode 564 and vice versa. As shown in FIG. 10A, the cathode filaments 512 overlap the main electrodes 562. Electrodes 566 also overlap the spaces midway between adjacent filaments 512. Each filament 512 corresponds to a group of electron shaping electrodes such as group 570 (including the main electrode 562 overlapping such filament, the two narrow electrodes 564 next to such main electrode and the two electrodes 566 immediately adjacent to such two electrodes 564) to which electrical potentials are applied to affect the path of electrons from the corresponding cathode filament traveling towards the anode. As shown in FIG. 10A, a voltage $V_0$ is applied to the main electron shaping electrode 562 that directly overlaps the corresponding filament when viewed in the viewing direction 540, such electrode defining the main electrode of the group. Electrical potentials $V_1$, $V_2$ are applied to the two pairs of electrodes 564, 566 immediately adjacent to the main electrode respectively as shown in FIG. 10A. In the preferred embodiment, $V_2$ is at a higher potential than $V_1$ which is in turn at a higher potential than $V_0$. In this manner, electrons emitted from the filament 512 are attracted in a lateral direction or in directions parallel or at small angles to plane A so as to increase the lateral spread of the electron cloud in a portion of chamber 508 between plane G and the back plate. This has the effect of increasing the density of electrons present midway between the two adjacent filaments 512 and therefore the density of electrons that impinge upon the portion 554' of the anode that overlaps the space halfway between two adjacent filaments. This therefore has the effect of increasing the uniformity of brightness of the display. This is illustrated in FIG. 10A by the more uniform spacing of electron paths 550' as compared to paths 550 in FIG. 9A. FIG. 10B is a graphical plot of the brightness of the display in FIG. 10A along the anode plane A. AS shown in FIG. 10B, the brightness at portions 552' of the anode directly overlapping the filaments is only slightly greater than that at the portion 554' overlapping the space halfway between the two adjacent filaments.

The path of electrons when traveling towards the anode are modulated by voltages applied to the two sets of grid electrodes G1 and G2 so that the electrons reach each phosphor dot at the appropriate pixels are addressed or scanned to display color images.

As discussed above, electrical noise and stray electrons in conventional CRT systems frequently cause pixels adjacent to the pixel addressed to become luminescent, resulting in crosstalk and degradation of the performance of display device. A spacer plate has been used to minimize crosstalk. This spacer plate is preferably made of photosensitive glass ceramic material such as Corning Fotoform glass. However, using photosensitive glass-ceramic material encounters limitation in the choice of size and availability of materials for large-area display. In the preferred embodiment that employs a one piece core multiple electrode structure, crosstalk is minimized by depositing or plating a thin conducting film G2 on the internal surface of the thin partition walls to provide low operating range voltage for focusing the electrons to directly impinge onto the proper pixel dot on the luminescence means; by contacting the spacer structure with the anode plate; and by increasing the distance between the high voltage anode plate and the control grid electrodes.

With the one piece core multiple electrode spacer structure 502 or 502' described above, the face and back plate may be made out of large glass plates that are less than 3 mm in thickness. The large-area spacer plate having an array of holes with dimensions in the range of about 0.05 to 5 mm., but preferably in the range of 0.1 to 0.2 mm., may be made of high resistive materials using photolithography and air abrasive jet and/or ultrasonic machining techniques. The electrodes G2 therefore also have dimensions in a plane parallel to the anode plane similar to those of the array of holes in the spacer plate. Grid electrode G2 may be formed on the inside surface of the partition wall with a thin conducting material such as aluminum, nickel and tungsten or by selective deposition techniques to define the grid electrode pattern. The one piece core multiple electrode structure assembly may be formed with very high precision by combining the individual subassemblies employing specially designed alignment fixtures and tools.

The large-area EFD flat television comprises the following subassemblies: (1) anode plate subassembly; (2) cathode plate subassembly; and (3) G1–G2 core subassembly. The anode plate is formed from the back face plate with a conducting film such as indium tin oxide ITO. Black glass frit is applied in selected area surrounding the phosphor to improve contrast. Then, the three primary colors red, green and blue phosphor dots are applied onto the glass plate. Thus, the anode plate is ready for the final assembly. Alignment control of the anode plate is accomplished using precise photolithographic process to define the pattern of black glass frit and phosphor dots. The cathode plate is formed from the ITO coated glass substrate with an array of pillars. Electron shaping electrodes are formed by patterning the ITO film. After forming the electron shaping electrode, glass sealing frit is applied to selected region for filament support mounting and to the peripheral of the plate for device sealing. At this time, gettering materials are installed into the getter slot for subsequent flashing. Finally, the filaments are mounted onto the filament supports, such as supports (not shown) on the back plate at its peripheral, to complete the cathode subassembly. The G1–G2 core electrode structure is formed from two components, namely the spacer plate and the G1 grid electrode. The spacer plates may be made out of glass-ceramic materials using various micromachining techniques or they may be made out of metal form coated with insulated material of specific different resistivity to eliminate wall charging effect. Such materials may be applied onto the metal form by various form of coating techniques such as evaporation, dip coating, etc.

The final assembly process flow involves the use of various alignment fixture to prevent the displacement of the various assemblies during the high temperature sealing of the large-area EFD device. First, the anode plate is mounted to an alignment fixture onto which the G1–G2 core subassemblies are properly aligned. Finally, the cathode subassemblies are also properly aligned to the core subassemblies. It will be apparent that such assembly process is simplified in the preferred embodiment by the fact that all subassemblies are aligned properly prior to the final assembly with the help of the alignment plate in the preferred embodiment.

It will be seen that the one piece core multiple electrode structure in this invention can be used to fabricate very large area EFD device without the associated problems encountered by most large-area display fabrication techniques. It will also be seen that the one piece multiple electrode structure design allows the formation of the metal conductors extending outside the glass frit area. This means that the electrodes can make direct contact to the outside drive circuit without the complicated procedures of soldering individual scanning electrodes.

In reference to FIGS. 5A and 6, the total thickness of layers 1 and 2 together is preferably in the range of 1–35 mm and the thickness of the separation spacers 502*c* is preferably of the order of 0.1–5 mm, so that the thickness of structure 502 may be in the range of about 1 to 40 mm. In reference to FIG. 9A, the distance between the cathode plane C and the closer one of the two grid planes G is of the order of 0.3–10 mm in the preferred embodiment. Where the thickness of the face and back plates is in the range of 0.5–10 mm, and the distance between the cathode plane C and the back electrode of the order of 0.3–5 mm, the total thickness of the device 500 is of the order of 4 to 40 mm. The potential difference between $V_0$ and $V_2$ in FIG. 10A is of the order of 0–500 volts, but preferably from 0 to 80 volts. Separation between adjacent cathode filaments is preferably of the order of 2–20 mm. The distance between the cathode plane C and the anode plane A is in the range of 4–40 mm. The anode is operated at a voltage between 0.5–8 kV with a preferable range of 1–8 kV. The operating voltage of the cathode is preferably below 100 volts and those of the grid electrodes G1, G2 below 200 volts with a typical range of 50–100 volts. The pixel dots 514*a*–514*c* each has preferably a width of less than about 0.3 mm. The support walls 502*a* has a typical width of 0.2–0.34 mm and separating walls 502*b* has a typical thickness of about 0.1–0.18 mm and the holes between a pair of adjacent separating walls 502*b* and between the separating wall 502*b* and adjacent support wall 502*a* is of the order of 0.2 mm. The support wall 502*a* and the tapering separating wall in FIG. 5B has a taper of preferably 3 degrees. The total width of the pixel is of the order of 1.3 mm with the black matrix portions having typical widths of 0.3 and 0.14 mm respectively. Layer 2 in FIG. 6 is preferably made of a material of volume electrical resistivity in the range of $10^8$–$10^{14}$ Ohms-cm. Where layer 1 of FIG. 6 is coated by a dielectric material, such material may be selected from one of the following: glass powder mixture, polyimide and siloxane.

Figure 11:
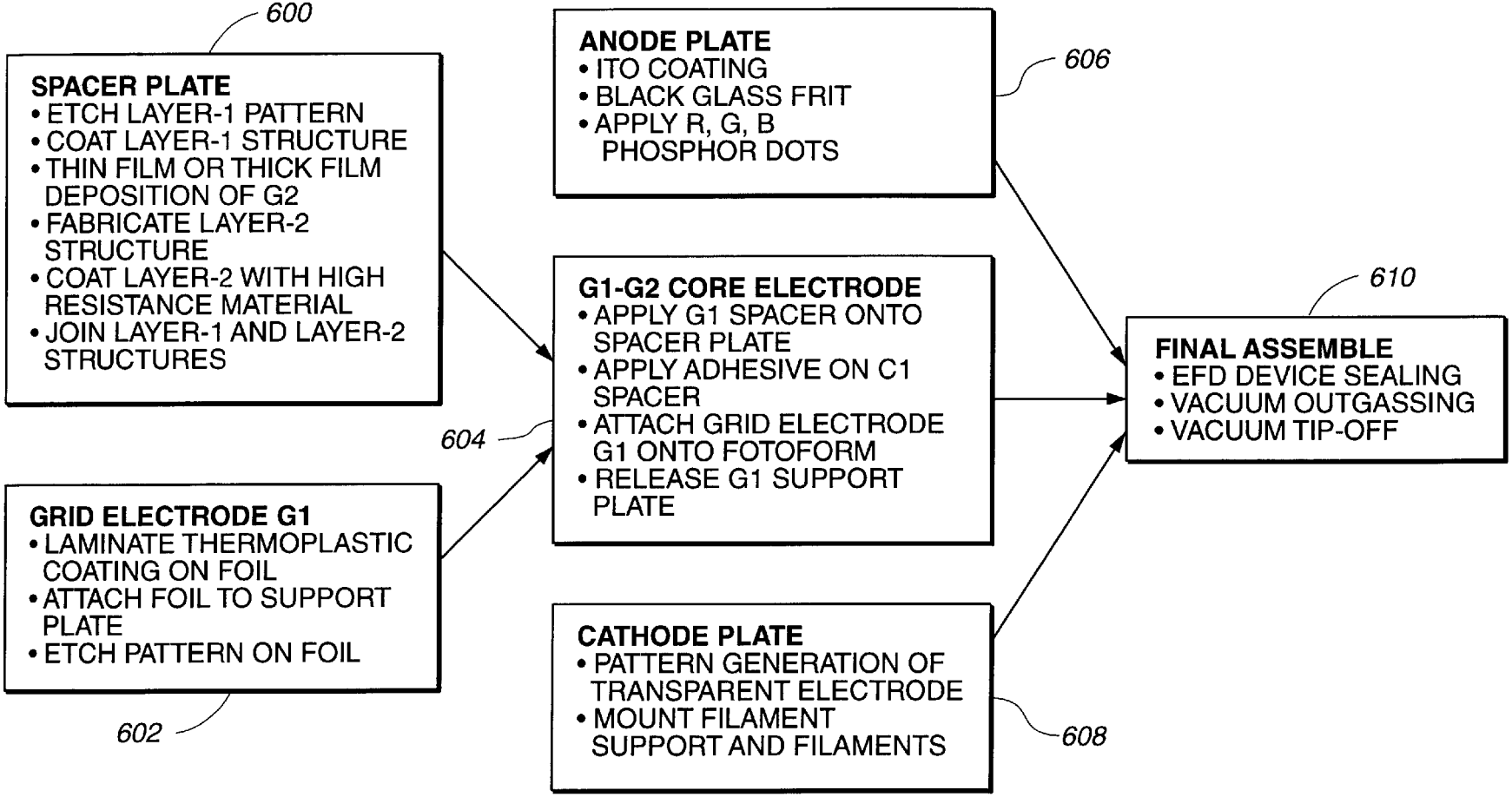
FIG. 11 is a flow chart illustrating a process for making an EFD device to illustrate the invention.

The process of assembly of device 500, 500' will now be described in detail in reference to FIG. 11. First, a pattern of holes is etched into a metal foil to form the inner metal frame of layer 1 in FIG. 6. The resulting structure is then coated with an insulating layer to form layer 1 of FIG. 6. Where a layer of glass or ceramic material is used instead of metal foil or form, of course the coating step may be omitted. A thin or thick film of an electrically conductive material is deposited on appropriate or selected portions of the inside surfaces of the holes of the layer one structure to form a set of grid electrodes G2. A pattern of holes are formed in a layer of material and then coated with a high resistance material to form layer 2 of FIG. 6. Layers 1 and 2 are securely joined or attached, such as by using an adhesive so that their support portions are aligned in a manner shown in FIG. 6. Such and other processes are illustrated in FIG. 11, where the process for making the spacer plate is illustrated in block 600. The set of grid electrodes G1 is formed as illustrated in block 602 in FIG. 11. A thermal plastic coating is laminated onto a metal foil. The foil is then attached to a support plate and a pattern is etched through the coating and the foil to form the set of grid electrodes G1. The spacer structure is then assembled by reference to the steps in block 604 in FIG. 11. First, a paste of a high temperature adhesive blend containing a spacer material such as glass beads is applied to the spacer plate. Then the set of grid electrodes G1 is attached through the thermoplastic coating onto the high temperature adhesive blend on top of the spacer plate, with the aid of the support plate. The adhesive blend is cured to firmly attach the electrodes G1 to the spacer plate. The support plate for the set of grid electrodes G1 is then removed by a process known to those skilled in the art, such as by ashing the thermoplastic at high temperature. The anode and cathode plates are formed by processes described above (blocks 606, 608). The pattern of holes formed in layers 1 and 2 are such as to match the size of the pixel dots on the anode plate and the pattern is etched on a metal foil to form grid electrodes G1 so that the density of electrodes G1 matches that of the phosphor dots on the anode plate. When the grid electrodes G1 are attached to the spacer plate, it is aligned so that the intersection points between the two sets of grid electrodes G1, G2 when viewed in a viewing direction would overlap the pixel dots on the anode plate. When the one piece integral spacer structure resulting from the steps in blocks 600, 602 and 604 are then assembled with the anode and cathode plates, this can be simply performed by aligning the one piece spacer structure with the pixel dots on the anode plate and matching the cathode filaments mounted on filament supports (not shown in the figures) with the grid electrodes and pixel dots. The face and back plates (anode and cathode plates) are then connected to any optional side walls or simply to each other to form a housing and chamber 508 is then evacuated (block 610) to form the cathodoluminescent device.

The invention has been described in detail in connection with a preferred embodiment thereof. It will be appreciated that many variations will occur to those skilled in the art. The scope of the invention is to be limited only by the appended claims.

What is claimed is:

1. A cathodoluminescent visual display device having a plurality of pixel dots for displaying images when said device is viewed in a viewing direction, comprising:

a housing defining a chamber therein, said housing having a face plate, and a back plate;

an anode on or near said face plate;

luminescent means that emits light in response to electrons, and that is on or adjacent to the anode;

at least one cathode in the chamber between the face and back plates;

a spacer structure defining holes therein for passage of electrons, said spacer structure comprising a plurality of spacer layers attached to form a unitary spacer structure;

at least a first and a second set of elongated grid electrodes between the anode and cathode and separated by at least one of said spacer layers, the electrodes in one of the first and second sets overlapping the luminescent means and grid electrodes in the other set at points when viewed in the viewing direction, wherein the overlapping points define pixel dots; wherein one of the first and second sets of grid electrodes comprises a layer of an electrically conductive material on surfaces within the holes of the spacer structure;

means for causing the cathode to emit electrons; and means for applying electrical potentials to the anode, cathode and the two or more sets of grid electrodes, causing the electrons emitted by the cathode to travel to the luminescent means at the pixel dots on or adjacent to the anode for displaying images, said electrical potentials applying means applying such potentials to the layer on the surfaces within the holes that electrons passing there through are focused onto selected pixel dots, wherein each of the holes of the spacer structure contains only one integral layer of electrically conductive material.

2. The device of claim 1, said spacer structure comprising at least a first and a second individual layer attached to form the unitary spacer structure;

said first layer having support portions and separation portions, said second layer having support portions corresponding to and attached to the support portions of the first layer to form the support wall between any two adjacent holes of the spacer structure.

3. The device of claim 2, said first layer being closer to the back plate than the face plate, and said second layer being closer to the face plate than the back plate, said separation portions of the first layer forming separation walls within each of said holes to divide each of said holes into smaller holes, said separation walls being thinner than the support walls, thereby reducing crosstalk.

4. The device of claim 2, said first layer comprising a metallic substrate and a dielectric material coating, and said second layer comprising a material of electrical resistance in the range of about $10^8$ to $10^{14}$ Ohms.

5. The device of claim 4, wherein said dielectric material coating comprises a glass powder mixture, polyimide or siloxane polymers.

6. The device of claim 4, wherein the total thickness of said first and second layers together is in the range of about 1 to 35 mm.

7. The device of claim 2, wherein said second set of grid electrodes comprises a thin film electrically conducting material on the support and separation portions of the first layer, said spacer structure further comprising separation spacers between and attached to the first set of grid electrodes and the first layer, said separation spacers comprising glass beads and a high temperature adhesive.

8. The device of claim 2, wherein said one of the first and second sets of grid electrodes comprises a thin film electrically conducting material on the support and separation portions of the first layer.

9. The device of claim 1, said spacer structure having a thickness in the range of 1 to 40 mm, wherein the distance between the at least one cathode and the anode is in the range of 4 to 40 mm.

10. The device of claim 9, said electrical potential applying means applying potentials so that the potential of the anode is in the range of 1 kV to 8 kV, the potential of the at least one cathode is less than about 100 V and the potentials of the two sets of grid electrodes are less than 200 V.

11. The device of claim 1, further comprising electron shaping electrodes on or adjacent to the back plate to control the emitted electrons from the cathode to be evenly distributed so as to improve brightness uniformity.

12. The device of claim 11, said device comprising a plurality of cathodes in the form of filaments in a spatial arrangement, wherein said electron shaping electrodes comprise layers of an electrically conducting material in a design pattern corresponding to the spatial arrangement of the filaments.

13. The device of claim 1, wherein said one integral layer of electrically conductive material in each of said the holes of the spacer structure extends over a substantial portion of the surface of such hole so that the electrical potential within such hole is substantially that applied by the applying means to the layer of electrically conductive material within such hole.

14. The device of claim 1, further comprising means for evacuating said chamber.

15. The device of claim 1, said at least one cathode comprising at least one filament, said device further comprising means for heating the at least one filament to emit electrons.

* * * * *